US011773854B2

(12) United States Patent
Lee et al.

(10) Patent No.: US 11,773,854 B2
(45) Date of Patent: Oct. 3, 2023

(54) ROTARY COMPRESSOR

(71) Applicant: LG ELECTRONICS INC., Seoul (KR)

(72) Inventors: Sedong Lee, Seoul (KR); Seoungmin Kang, Seoul (KR); Joonhong Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/961,672

(22) Filed: Oct. 7, 2022

(65) Prior Publication Data

US 2023/0131102 A1 Apr. 27, 2023

(30) Foreign Application Priority Data

Oct. 21, 2021 (KR) ..... 10-2021-0141168

(51) Int. Cl.
*F03C 2/00* (2006.01)
*F03C 4/00* (2006.01)
(Continued)

(52) U.S. Cl.
CPC ..... *F04C 18/3568* (2013.01); *F04C 18/344* (2013.01); *F04C 29/126* (2013.01);
(Continued)

(58) Field of Classification Search
CPC ..... F04C 18/344; F04C 18/3564; F04C 18/3568; F04C 23/001; F04C 23/008;
(Continued)

(56) References Cited

U.S. PATENT DOCUMENTS 6,893,237 B2 * 5/2005 Yamanaka ..... F04C 23/001 418/60
2012/0141312 A1 * 6/2012 Lee ..... F04C 29/023 418/183
(Continued)

FOREIGN PATENT DOCUMENTS

CN 111963429 11/2020
CN 111963431 11/2020
(Continued)

OTHER PUBLICATIONS

KR20190001192A—Moon et al.—Compressor Having Micro Groove—Jan. 4, 2019—the English Machine Translation (Year: 2019).*
(Continued)

*Primary Examiner* — Theresa Trieu
(74) *Attorney, Agent, or Firm* — KED & ASSOCIATES

(57) ABSTRACT

A rotary compressor may include an outflow passage through which refrigerant flows out of a compression space. The outflow passage may include at least one first outflow guide portion disposed in a main bearing or a sub bearing, at least one second outflow guide portion formed through between both axial ends of a roller, and at least one third outflow guide portion disposed in a bearing opposite to the bearing with the at least one first outflow guide portion based on the roller. This may minimize an amount of refrigerant remaining in the compression space. A pressure difference on a front of a vane may also be eliminated, which may suppress or prevent vane jumping. As the outflow passage is periodically opened, refrigerant leakage may be suppressed or prevented during a compression stroke.

20 Claims, 19 Drawing Sheets

(51) Int. Cl.

| | |
|---|---|
| ***F04C 2/00*** | (2006.01) |
| ***F04C 18/356*** | (2006.01) |
| ***F04C 18/344*** | (2006.01) |
| ***F04C 29/12*** | (2006.01) |
| *F04C 23/00* | (2006.01) |

(52) U.S. Cl.
CPC ..... *F04C 23/001* (2013.01); *F04C 2240/20* (2013.01); *F04C 2240/50* (2013.01)

(58) Field of Classification Search
CPC ..... F04C 29/02; F04C 29/023; F04C 29/06; F04C 29/068; F04C 29/12; F04C 29/126; F04C 2240/10; F04C 2240/20; F04C 2240/30; F04C 2240/50
See application file for complete search history.

(56) References Cited

U.S. PATENT DOCUMENTS

| | | | | |
|---|---|---|---|---|
| 2014/0241928 | A1 | 8/2014 | Moetakef et al. | |
| 2014/0369878 | A1 | 12/2014 | Shimaguchi et al. | |
| 2020/0277956 | A1* | 9/2020 | Noh | F04C 18/344 |

FOREIGN PATENT DOCUMENTS

| | | | | | |
|---|---|---|---|---|---|
| CN | 112145417 | | | 12/2020 | |
| CN | 112145417 | A | * | 12/2020 | F04C 18/3445 |
| CN | 114151347 | | | 3/2022 | |
| EP | 1298324 | | | 4/2003 | |
| EP | 3527828 | | | 8/2019 | |
| JP | S57-146088 | | | 9/1982 | |
| JP | 2000-265984 | | | 9/2000 | |
| JP | 2013-072429 | | | 4/2013 | |
| KR | 20190001192 | A | * | 1/2019 | F04C 18/344 |
| KR | 10-1964957 | | | 4/2019 | |

OTHER PUBLICATIONS

CN-112145417-A—Dong et al.—A Kind of Compressor and Air Conditioner—Dec. 29, 2020—the English Machine Translation (Year: 2020).*

Korean Notice of Allowance dated Feb. 27, 2023 issued in Application No. 10-2021-0141168.

European Search Report dated Mar. 22, 2023 issued in Application No. 22198676.3.

* cited by examiner

ROTARY COMPRESSOR

CROSS-REFERENCE TO RELATED APPLICATION(S)

Pursuant to 35 U.S.C. § 119(a), this application claims the benefit of the earlier filing date and the right of priority to Korean Patent Application No. 10-2021-0141168, filed in Korea on Oct. 21, 2021, the contents of which are incorporated by reference herein in their entirety.

BACKGROUND

1. Field

A vane rotary compressor is disclosed herein.

2. Background

Rotary compressors may be classified into a type in which a vane is slidably inserted into a cylinder to be brought into contact with a roller, and another type in which a vane is slidably inserted into a roller to be brought into contact with a cylinder. The former is called an "eccentric rotary compressor", and the latter is classified as a "vane rotary compressor" (or "concentric rotary compressor").

As for the eccentric rotary compressor, the vane inserted in the cylinder is pulled out toward the roller by elastic force or back pressure to be brought into contact with an outer circumferential surface of the roller. On the other hand, as for the vane rotary compressor, the vane inserted in the roller is pulled out toward the cylinder by centrifugal force and back pressure while rotating together with the roller, so as to be brought into contact with an inner circumferential surface of the cylinder.

The eccentric rotary compressor independently forms as many compression chambers as the number of vanes per revolution of the roller, and the respective compression chambers simultaneously perform suction, compression, and discharge strokes. On the other hand, the vane rotary compressor continuously forms as many compression chambers as the number of vanes per revolution of the roller, and the respective compression chambers sequentially perform suction, compression, and discharge strokes. Accordingly, the vane rotary compressor has a higher compression ratio than the eccentric rotary compressor. Therefore, the vane rotary compressor is more suitable for high pressure refrigerants such as R32, R410a, and $CO_2$, which have low ozone depletion potential (ODP) and global warming index (GWP).

Each of U.S. Patent Publication No. US2014/0369878 A1 (hereinafter "Patent Document 1"), Japanese Patent Application Laid-Open No. 2000-265984 (hereinafter "Patent Document 2"), and Japanese Patent Application Laid-Open No. 2013-072429 (hereinafter "Patent Document 3"), which are hereby incorporated by reference, disclose a vane rotary compressor. In these vane rotary compressors, a contact point at which an outer circumferential surface of the roller and an inner circumferential surface of the cylinder are substantially in contact with each other is located between a discharge port and a suction port, so as to separate the discharge port and the suction port from each other.

However, in the related art vane rotary compressors, a gap is formed in a circumferential direction between the discharge port and the contact point. Due to this, compressed refrigerant is not completely discharged in the discharge stroke, and some of the compressed refrigerant remain in a space defined between the discharge port and the contact point. This refrigerant flows back into the subsequent compression chamber to cause over-compression, thereby increasing motor input and reducing compressor efficiency.

In addition, in the related art vane rotary compressors, pressure on a front side of the vane is excessively increased due to the over-compression of the residual refrigerant, and chattering of the vane occurs. The chattering of the vane increases vibration noise of the vane and damages a front surface of the vane and the inner circumferential surface of the cylinder, thereby causing a risk of lowering reliability of the compressor.

In addition, in the related art vane rotary compressors, while the chattering of the vane continues, the refrigerant in the compression stroke flows back to the suction stroke, thereby heating refrigerant in the suction stroke. Due to this, a specific volume of suction refrigerant may increase and an amount of suction refrigerant may decrease, which may cause suction loss, thereby reducing compressor efficiency.

In addition, in the related art vane rotary compressors, when a discharge port is formed in the cylinder, surface pressure between a front surface of the vane passing through the discharge port and an inner circumferential surface of the cylinder is increased but is not uniform, so that the front surface of the vane or the inner circumferential surface of the cylinder may be worn out. In addition, as a valve accommodation groove is formed in an outer circumferential surface of the cylinder, processing of the cylinder becomes complicated and manufacturing costs increase. The valve accommodation groove may lower rigidity of the cylinder and increases the chattering of the vane, thereby further increasing the vibration noise of the compressor.

BRIEF DESCRIPTION OF THE DRAWINGS

Embodiments will be described in detail with reference to the following drawings in which like reference numerals refer to like elements, and wherein.

DETAILED DESCRIPTION

Description will now be given of a vane rotary compressor according to exemplary embodiments disclosed herein, with reference to the accompanying drawings.

Embodiments disclosed herein describe a structure in which a vane spring is disposed in a roller, which may be equally applied to a vane rotary compressor in which a vane is slidably inserted into a roller. For example, embodiments may be equally applicable not only to a vane rotary compressor having an elliptical (hereinafter, asymmetric elliptical) cylinder, an inner circumferential surface of which has a plurality of curvatures, but also to a vane rotary compressor having a circular cylinder, an inner circumferential surface of which has one curvature. Embodiments may also be equally applicable to a vane rotary compressor in which a vane slot into which a vane is slidably inserted is inclined by a predetermined angle with respect to a radial direction of a roller, as well as a vane rotary compressor in which a vane slot is formed in a radial direction of a roller. Hereinafter, an example in which an inner circumferential surface of a cylinder has an asymmetric elliptical shape and a vane slot is inclined with respect to a radial direction of a roller will be described as a representative example.

Figure 1:
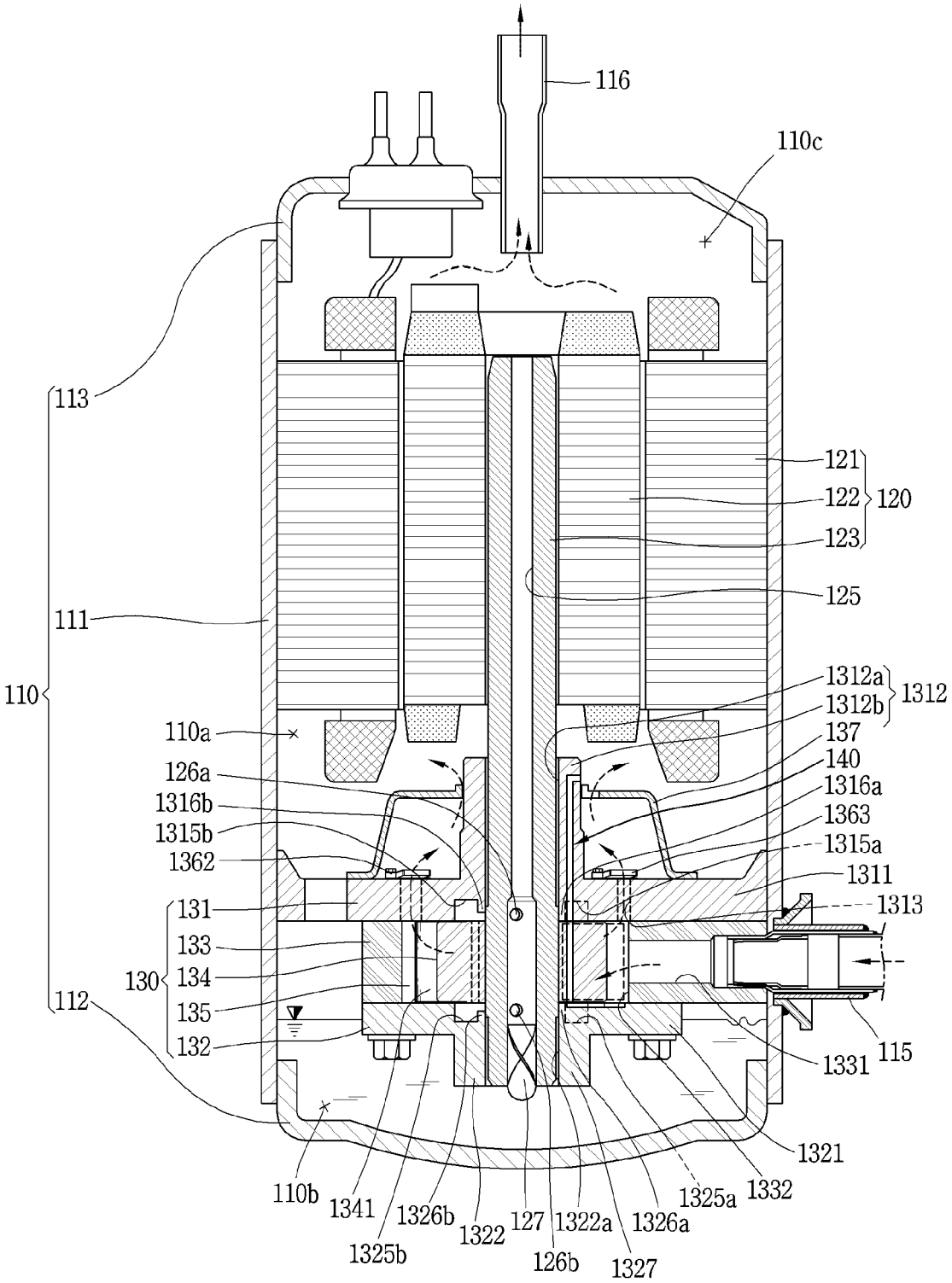
FIG. 1 is a cross-sectional view of a vane rotary compressor according to an embodiment.
Figure 2:
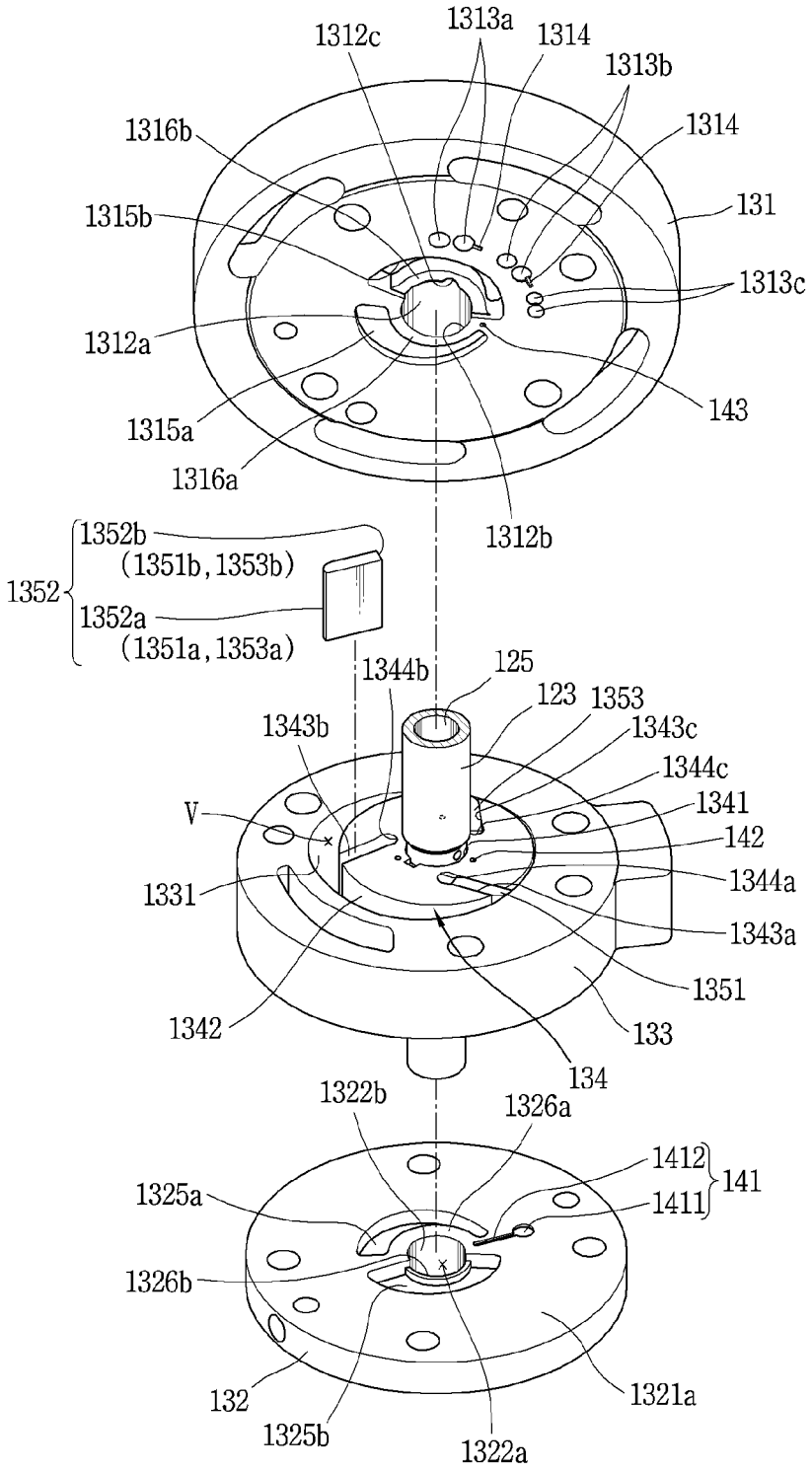
FIG. 2 is an exploded perspective view illustrating a portion of a compression part in FIG. 1.
Figure 3:
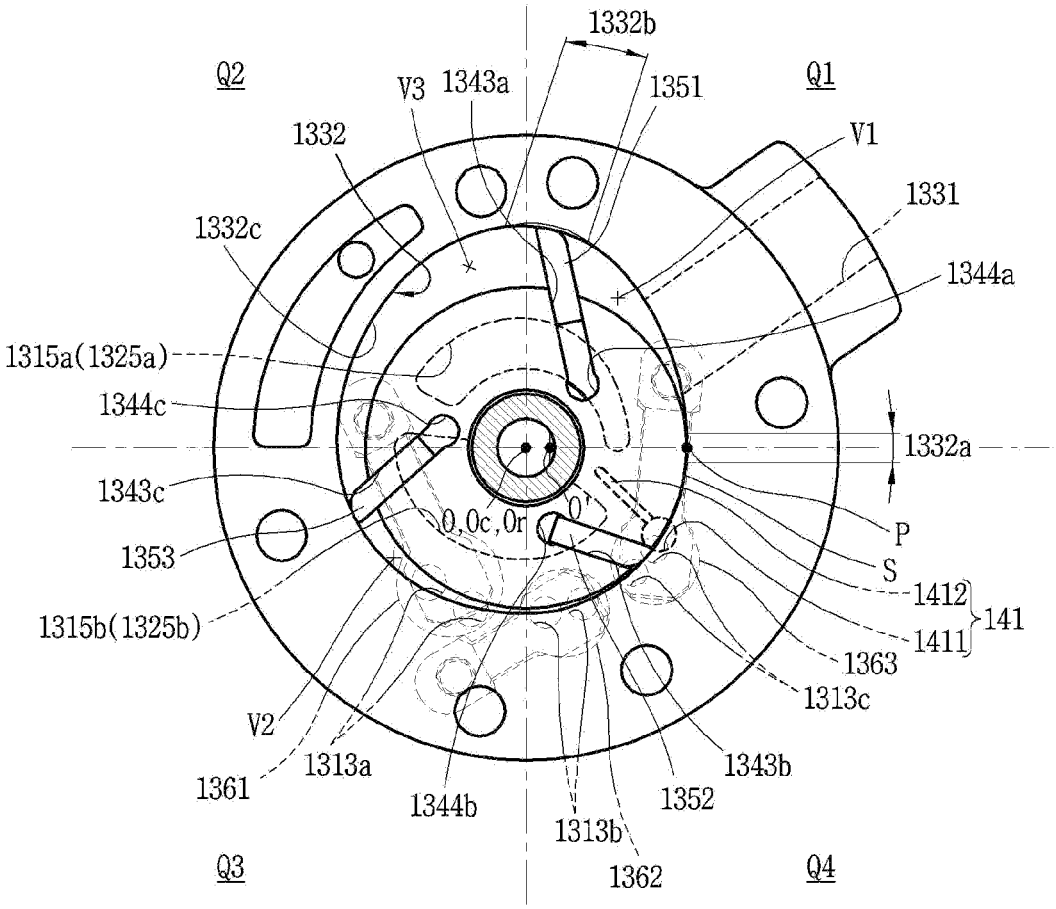
FIG. 3 is an assembled planar view of the compression part in FIG. 2.

FIG. 1 is a cross-sectional view of a vane rotary compressor according to an embodiment. FIG. 2 is an exploded perspective view illustrating a compression part in FIG. 1, and FIG. 3 is an assembled planar view of the compression part in FIG. 2.

Referring to FIG. 1, a vane rotary compressor according to this embodiment may include a casing 110, a drive motor 120, and a compression part or portion 130. The drive motor 120 may be installed in an upper inner space 110*a* of the casing 110, and the compression part 130 may be installed in a lower inner space 110*a* of the casing 110. The drive motor 120 and the compression part 130 may be connected through a rotational shaft 123.

The casing 110 that defines an outer appearance of the compressor may be classified as a vertical type and a horizontal type according to a compressor installation method. As for the vertical type casing, the drive motor 120 and the compression part 130 are disposed at upper and lower sides in an axial direction, respectively. As for the horizontal type casing, the drive motor 120 and the compression part 130 are disposed at left and right or lateral sides, respectively. The casing according to this embodiment may be illustrated as the vertical type.

The casing 110 may include an intermediate shell 111 having a cylindrical shape, a lower shell 112 may cover a lower end of the intermediate shell 111, and an upper shell 113 may cover an upper end of the intermediate shell 111. The drive motor 120 and the compression part 130 may be inserted into the intermediate shell 111 to be fixed thereto, and a suction pipe 115 may penetrate through the intermediate shell 111 to be directly connected to the compression part 130. The lower shell 112 may be coupled to the lower end of the intermediate shell 111 in a sealing manner, and an oil storage space 110*b* in which oil to be supplied to the compression part 130 is stored may be formed below the compression part 130. The upper shell 113 may be coupled to the upper end of the intermediate shell 111 in a sealing manner, and an oil separation space 110*c* may be formed above the drive motor 120 to separate oil from refrigerant discharged from the compression part 130.

The drive motor 120 constitutes a motor that supplies power to cause the compression part 130 to be driven. The drive motor 120 may include a stator 121, a rotor 122, and the rotational shaft 123.

The stator 121 may be fixedly inserted into the casing 110. The stator 121 may be fixed to an inner circumferential surface of the casing 110 in a shrink-fitting manner, for example. For example, the stator 121 may be press-fitted into an inner circumferential surface of the intermediate shell 111.

The rotor 122 may be rotatably inserted into the stator 121, and the rotational shaft 123 may be press-fitted into a center of the rotor 122. Accordingly, the rotational shaft 123 rotates concentrically together with the rotor 122.

An oil flow path 125 having a hollow hole shape may be formed in a central portion of the rotational shaft 123, and oil passage holes 126*a* and 126*b* may be formed through a middle portion of the oil flow path 125 toward an outer circumferential surface of the rotational shaft 123. The oil passage holes 126*a* and 126*b* may include first oil passage hole 126*a* belonging to a range of a main bush portion 1312 described hereinafter and second oil passage hole 126*b* belonging to a range of a sub bush portion 1322. Each of the first oil passage hole 126*a* and the second oil passage hole 126*b* may be provided as one or a plurality. In this embodiment, each of the first and second oil passage holes is provided as a plurality.

An oil pickup 127 may be installed at a middle or lower end of the oil flow path 125. A gear pump, a viscous pump, or a centrifugal pump may be used for the oil pickup 127, for example. This embodiment illustrates a case in which the centrifugal pump is employed. Accordingly, when the rotational shaft 123 rotates, oil filled in the oil storage space 110*b* is pumped by the oil pickup 127 and is suctioned along the oil flow path 125, so as to be introduced into a sub bearing surface 1322*b* of the sub bush portion 1322 through the second oil passage hole 126*b* and into a main bearing surface 1312*b* of the main bush portion 1312 through the first oil passage hole 126*a*.

The rotational shaft 123 may include a roller 134 described hereinafter. The roller 134 may extend integrally from the rotational shaft 123 or the rotational shaft 123 and the roller 134 separately manufactured may be post-assembled to each other. In this embodiment, the rotational shaft 123 is post-assembled by being inserted into the roller 134. For example, a shaft hole 1341 may be formed through a center of the roller 134 in an axial direction and the rotational shaft 123 may be press-fitted into the shaft hole 1341 or coupled to the shaft hole 1341 to be movable in the axial direction. When the rotational shaft 123 is movably coupled to the roller 134 in the axial direction, a rotation preventing unit (not illustrated) may be provided between the rotational shaft 123 and the roller 134 so that the rotational shaft 123 may be locked with respect to the roller 134 in the circumferential direction.

The compression part 130 may include a main bearing 131, a sub bearing 132, a cylinder 133, roller 134, and a plurality of vanes 135 (1351, 1352, and 1353). The main bearing 131 and the sub bearing 132 may be respectively provided at upper and lower parts or portions of the cylinder 133 to define a compression space V together with the cylinder 133, the roller 134 may be rotatably installed in the compression space V, and the vanes 1351, 1352, and 1353 may be slidably inserted into the roller 134 to divide the compression space V into a plurality of compression chambers.

Referring to FIGS. 1 to 3, the main bearing 131 may be fixedly installed in the intermediate shell 111 of the casing 110. For example, the main bearing 131 may be inserted into the intermediate shell 111 and welded thereto.

The main bearing 131 may be coupled to an upper end of the cylinder 133 in a close contact manner. Accordingly, the main bearing 131 defines an upper surface of the compression space V, and supports an upper surface of the roller 134 in the axial direction and at the same time supports an upper portion of the rotational shaft 123 in the radial direction.

The main bearing 131 may include a main plate portion 1311 and a main bush portion 1312. The main plate portion 1311 covers an upper part or portion of the cylinder 133 to be coupled thereto, and the main bush portion 1312 axially extends from a center of the main plate portion 1311 toward the drive motor 120 so as to support the upper portion of the rotational shaft 123.

The main plate portion 1311 may have a disk shape, and an outer circumferential surface of the main plate portion 1311 may be fixed to the inner circumferential surface of the intermediate shell 111 in a close contact manner. One or more discharge ports 1313*a*, 1313*b*, and 1313*c* may be formed in the main plate portion 1311, a plurality of discharge valves 1361, 1362, and 1363 configured to open and close the respective discharge ports 1313*a*, 1313*b*, and 1313*c* may be installed on an upper surface of the main plate portion 1311, and a discharge muffler 137 having a discharge space (no reference numeral) may be provided at an upper part or portion of the main plate portion 1311 to accommodate the discharge ports 1313*a*, 1313*b*, and 1313*c*, and the discharge valves 1361, 1362, and 1363.

Accordingly, the discharge ports 1313*a*, 1313*b*, and 1313*c* may be formed in the main bearing (or sub bearing) 131, instead of the cylinder 133, which may simplify the structure of the cylinder 133 so as to facilitate processing of the cylinder 133. In addition, surface pressure between a front surface of the vane 133 in a vicinity of the discharge port 1313*a*, 1313*b*, 1313*c* and the inner circumferential surface of the cylinder 131 facing it may be lowered and constantly maintained at the same time, while chattering of the vane 1351, 1352, 1353 may be reduced so as to suppress or prevent wear and vibration noise between the front surface of the vane 1351, 1352, 1353 and the inner circumferential surface of the cylinder 133 facing it. The discharge ports will be described hereinafter.

A first main back pressure pocket 1315*a* and a second main back pressure pocket 1315*b* may be formed in a lower surface, namely, a main sliding surface 1311*a* of the main plate portion 1311 facing the upper surface of the roller 134, of both axial side surfaces of the main plate portion 1311. The first main back pressure pocket 1315*a* and the second main back pressure pocket 1315*b* each having an arcuate shape may be disposed at a predetermined interval in a circumferential direction. Each of the first main back pressure pocket 1315*a* and the second main back pressure pocket 1315*b* may have an inner circumferential surface with a circular shape, but may have an outer circumferential surface with an oval or elliptical shape in consideration of vane slots described hereinafter.

The first main back pressure pocket 1315*a* and the second main back pressure pocket 1315*b* may be formed within an outer diameter range of the roller 134. Accordingly, the first main back pressure pocket 1315*a* and the second main back pressure pocket 1315*b* may be separated from the compression space V. However, the first main back pressure pocket 1315*a* and the second main back pressure pocket 1315*b* may slightly communicate with each other through a gap between a lower surface, a main sliding surface 1311*a* of the main plate portion 1311 and the upper surface of the roller 134 facing each other unless a separate sealing member is provided therebetween.

The first main back pressure pocket 1315*a* forms a pressure lower than a pressure formed in the second main back pressure pocket 1315*b*, for example, forms an intermediate pressure between a suction pressure and a discharge pressure. Oil (refrigerant oil) may pass through a fine passage between a first main bearing protrusion 1316*a* described hereinafter and the upper surface of the roller 134 so as to be introduced into the main back pressure pocket 1315*a*. The first main back pressure pocket 1315*a* may be formed in the range of a compression chamber forming the intermediate pressure in the compression space V. This may allow the first main back pressure pocket 1315*a* to maintain the intermediate pressure.

The second main back pressure pocket 1315*b* may form a pressure higher than that in the first main back pressure pocket 1315*a*, for example, the discharge pressure or the intermediate pressure between the suction pressure close to the discharge pressure and the discharge pressure. Oil flowing into the main bearing hole 1312*a* of the main bush portion 1312 through the first oil passage hole 126*a* may be introduced into the second main back pressure pocket 1315*b*. The second main back pressure pocket 1315*b* may be formed in the range of a compression chamber forming the discharge pressure in the compression space V. This may allow the second main back pressure pocket 1315*b* to maintain the discharge pressure.

In addition, a first main bearing protrusion 1316*a* and a second main bearing protrusion 1316*b* may be formed on inner circumferential sides of the first main back pressure pocket 1315*a* and the second main back pressure pocket 1315*b*, respectively, in a manner of extending from the main bearing surface 1312*b* of the main bush potion 1312. Accordingly, the first main back pressure pocket 1315*a* and the second main back pressure pocket 1315*b* may be sealed from outside and simultaneously the rotational shaft 123 may be stably supported.

The first main bearing protrusion 1316*a* and the second main bearing protrusion 1316*b* may have a same height or different heights. For example, when the first main bearing protrusion 1316*a* and the second main bearing protrusion 1316*b* have the same height, an oil communication groove (not illustrated) or an oil communication hole (not illustrated) may be formed on an end surface of the second main bearing protrusion 1316*b* such that inner and outer circumferential surfaces of the second main bearing protrusion 1316*b* may communicate with each other. Accordingly, high-pressure oil (refrigerant oil) flowing into the main bearing surface 1312*b* may be introduced into the second main back pressure pocket 1315*b* through the oil communication groove (not illustrated) or the oil communication hole (not illustrated).

On the other hand, when the first main bearing protrusion 1316*a* and the second main bearing protrusion 1316*b* have different heights, the height of the second main bearing protrusion 1316*b* may be lower than the height of the first main bearing protrusion 1316*a*. Accordingly, high-pressure oil (refrigerant oil) flowing into the main bearing hole 1312*a* may be introduced into the second main back pressure pocket 1315*b* by passing over the second main bearing protrusion 1316*b*.

In addition, a third outflow guide portion 143 defining a part or portion of a residual refrigerant outflow passage 140 described hereinafter may be formed on the main sliding surface 1311*a*. The third outflow guide portion 143 may be formed between the first main back pressure pocket 1315*a* and the second main back pressure pocket 1315*b*. A first end 143*a* of the third outflow guide portion 143 may be formed to periodically communicate with a second end 142*b* of a second outflow guide portion 142 of the roller 134 described hereinafter, and a second end 143*b* of the third outflow guide portion 143 may be formed through the main bush portion 1312 described hereinafter in the axial direction to be open toward the inner space 110*a* of the casing 110. The third outflow guide portion 143 will be described hereinafter along with the residual refrigerant outflow passage 140.

The main bush portion 1312 may be formed in a hollow bush shape, and a first oil groove 1312*c* may be formed in an inner circumferential surface of the main bearing hole 1312*a* that defines an inner circumferential surface of the main bush portion 1312. The first oil groove 1312*c* may be formed in a straight or inclined shape between upper and lower ends of the main bush portion 1312 to communicate with the first oil passage hole 126*a*.

Referring to FIGS. 1 to 3, the sub bearing 132 may be coupled to a lower end of the cylinder 133 in a close contact manner. Accordingly, the sub bearing 132 defines a lower surface of the compression space V, and supports a lower surface of the roller 134 in the axial direction and at the same time supports a lower portion of the rotational shaft 123 in the radial direction.

The sub bearing 132 may include a sub plate potion 1321 and the sub bush portion 1322. The sub plate portion 1321 may cover a lower part or portion of the cylinder 133 to be coupled thereto, and the sub bush portion 1322 may axially extend from a center of the sub plate portion 1321 toward the lower shell 112 so as to support the lower portion of the rotational shaft 123.

The sub plate portion 1321 may have a disk shape like the main plate portion 1311. An outer circumferential surface of the sub plate portion 1321 may be spaced apart from the inner circumferential surface of the intermediate shell 111.

A first sub back pressure pocket 1325*a* and a second sub back pressure pocket 1325*b* may be formed on an upper surface, namely, a sub sliding surface 1321*a* of the sub plate portion 1321 facing the lower surface of the roller 134, of both axial side surfaces of the sub plate portion 1321. The first sub back pressure pocket 1325*a* and the second sub back pressure pocket 1325*b* may be symmetric to the first main back pressure pocket 1315*a* and the second main back pressure pocket 1315*b*, respectively, with respect to the roller 134.

For example, the first sub back pressure pocket 1325*a* and the first main back pressure pocket 1315*a* may be symmetric to each other, and the second sub back pressure pocket 1325*b* and the second main back pressure pocket 1315*b* may be symmetric to each other. Accordingly, a first sub bearing protrusion 1326*a* may be formed on an inner circumferential side of the first sub back pressure pocket 1325*a*, and a second sub bearing protrusion 1326*b* may be formed on an inner circumferential side of the second sub back pressure pocket 1325*b*. Descriptions of the first sub back pressure pocket 1325*a* and the second sub back pressure pocket 1325*b*, and the first sub bearing protrusion 1326*a* and the second sub bearing protrusion 1326*b* may be the same as the descriptions of the first main back pressure pocket 1315*b* and the second main back pressure pocket 1316*b*, and the first main bearing protrusion 1316*a* and the second main bearing protrusion 1316*b*.

However, in some cases, the first sub back pressure pocket 1325*a* and the second sub back pressure pocket 1325*b* may be asymmetric to the first main back pressure pocket 1315*a* and the second main back pressure pocket 1315*b*, respectively, with respect to the roller 134. For example, the first sub back pressure pocket 1325*a* and the second sub back pressure pocket 1325*b* may be formed to be deeper than the first main back pressure pocket 1315*a* and the second main back pressure pocket 1315*b*, respectively.

In addition, a first outflow guide portion (first outflow guide) 141 defining a part or portion of a residual refrigerant outflow passage 140 described hereinafter may be formed on the sub sliding surface 1321*a*. The first outflow guide portion 141 may be formed between the first sub back pressure pocket 1325*a* and the second sub back pressure pocket 1325*b*. One (first) side of the first outflow guide portion 141 may communicate with the compression space V, more precisely, a residual space S, and another (second) side of the first outflow guide portion 141 may periodically communicate with the second outflow guide portion 142 described hereinafter, which is disposed in the roller 134. The first outflow guide portion 141 will be described hereinafter along with the residual refrigerant outflow passage 140.

The sub bush portion 1322 may be formed in a hollow bush shape, and an oil groove (not illustrated) may be formed in an inner circumferential surface of the sub bearing hole 1322*a* that defines an inner circumferential surface of the sub bush portion 1322. The oil groove (not illustrated) may be formed in a straight or inclined shape between upper and lower ends of the sub bush portion 1322 to communicate with the second oil passage hole 126*b*.

Although not illustrated in the drawings, the back pressure pockets 1315*a*, 1315*b*, 1325*a*, 1325*b* may be provided only at any one of the main bearing 131 and the sub bearing 132.

The discharge port 1313 may be formed in the main bearing 131 as described above. However, the discharge port 1313 may be formed in the sub bearing 132, formed in each of the main bearing 131 and the sub bearing 132, or formed by penetrating between inner and outer circumferential surfaces of the cylinder 133. This embodiment describes an example in which the discharge ports 1313 are formed in the main bearing 131.

The discharge port 1313 may be provided as one. However, in this embodiment, the plurality of discharge ports 1313*a*, 1313*b*, and 1313*c* may be formed at predetermined intervals along a compression proceeding direction (or a rotational direction of the roller).

In general, in the vane rotary compressor, as the roller 134 is arranged eccentrically with respect to the compression space V, a contact point P at which the roller 134 and the cylinder 133 almost come in contact with each other is generated between an outer circumferential surface 1342 of the roller 134 and an inner circumferential surface 1332 of the cylinder 133. The discharge port 1313 is formed adjacent to the contact point P at an opposite side of the suction port 1331 with respect to the contact point P. Accordingly, as the compression space V approaches the contact point P, a distance between the inner circumferential surface 1332 of the cylinder 133 and the outer circumferential surface 1342 of the roller 134 is greatly decreased, which makes it difficult to secure an area of the discharge port 1313.

Therefore, the discharge port 1313 according to this embodiment may be divided into a plurality of discharge ports 1313*a*, 1313*b*, and 1313*c* each having a small inner diameter, and the plurality of discharge ports 1313*a*, 1313*b*, 1313*c* may be disposed at preset or predetermined intervals along a circumferential direction, namely, the rotational direction of the roller 134.

In addition, the plurality of discharge ports 1313*a*, 1313*b*, and 1313*c* may be formed individually, but may also be formed as pairs, as illustrated in this embodiment. For example, starting from a discharge port which is the most adjacent to the proximal portion 1332*a*, the first discharge port 1313*a*, the second discharge port 1313*b*, and the third discharge port 1313*c* of the discharge port 1313 may be sequentially arranged.

A distance between the adjacent discharge ports 1313*a*, 1313*b*, and 1313*c* may be formed to be substantially the same. For example, a first distance between a rear end of the first discharge port 1313*a* and a front end of the second discharge port 1313*b* may be substantially the same as a second distance between a rear end of the second discharge port 1313*b* and a front end of the third discharge port 1313*c*.

In addition, a distance from the front end to a rear end of the discharge port 1313, that is, an arcuate length of the discharge port 1313 may be substantially the same as an arcuate length of each compression chamber V1, V2, V3. For example, the arcuate length between a front end of the first discharge port 1313*a* and the rear end of the third discharge port 1313*b* may be approximately similar to a distance between a preceding vane and a succeeding vane, namely, the arcuate length of each compression chamber V1, V2, V3.

However, in some cases, the arcuate length between the front end of the first discharge port 1313*a* and the rear end of the third discharge port 1313*b* may be greater than the distance between a preceding vane and a succeeding vane, namely, the arcuate length of each compression chamber V1, V2, V3. In this case, continuous discharge may be allowed as at least one compression chamber V1, V2, V3 is located within a circumferential range of the discharge port 1313, which may suppress or prevent over-compression and/or pressure pulsation.

Although not illustrated, when vane slots 1343*a*, 1343*b*, and 1343*c* described hereinafter are formed at unequal intervals, a circumferential length of each compression chamber V1, V2, V3 may be different, and the plurality of discharge ports may communicate with one compression chamber or one discharge port may communicate with the plurality of compression chambers. In addition, the plurality of discharge ports 1313*a*, 1313*b*, and 1313*c* may be opened and closed by the discharge valves 1361, 1362, and 1363, respectively. Each of the discharge valves 1361, 1362, and 1363 may be implemented as a cantilever type reed valve having one (first) end fixed and another (second) end free. These discharge valves 1361, 1362, and 1362 are widely known in the conventional rotary compressor, so detailed description thereof has been omitted.

Referring to FIGS. 1 to 3, the cylinder 133 according to this embodiment may be in close contact with a lower surface of the main bearing 131 and be coupled to the main bearing 131 by, for example, a bolt together with the sub bearing 132. Accordingly, the cylinder 133 may be fixedly coupled to the casing 110 by the main bearing 131.

The cylinder 133 may be formed in an annular shape having a hollow space in its center to define the compression space V. The hollow space may be sealed by the main bearing 131 and the sub bearing 132 to define the compression space V, and the roller 134 described hereinafter may be rotatably coupled to the compression space V.

The cylinder 133 may be provided with a suction port 1331 that penetrates from an outer circumferential surface to an inner circumferential surface thereof. However, the suction port may alternatively be formed through the main bearing 131 or the sub bearing 132.

The suction port 1331 may be formed at one (first) side of the contact point P in the circumferential direction. The discharge port 1313 described above may be formed through the main bearing 131 at another (second) side of the contact point P in the circumferential direction which is opposite to the suction port 1331.

The inner circumferential surface 1332 of the cylinder 133 may be formed in an elliptical shape. The inner circumferential surface 1332 of the cylinder 133 according to this embodiment may be formed in an asymmetric elliptical shape in which a plurality of ellipses, for example, four ellipses having different major and minor ratios are combined to have two origins.

That is, the inner circumferential surface 1332 of the cylinder 133 according to this embodiment may be defined to have a first origin O that is a center of the roller 134 or a center of rotation of the roller 134 (an axial center or a diameter center of the cylinder) and a second origin O' biased from the first origin O toward the contact point P. An X-Y plane formed around the first origin O may define a third quadrant Q3 and a fourth quadrant Q4, and an X-Y plane formed around the second origin O' may define a first quadrant Q1 and a second quadrant Q2. The third quadrant Q3 may be formed by a third ellipse, the fourth quadrant Q4 may be formed by a fourth ellipse, the first quadrant Q1 may be formed by the first ellipse, and the second quadrant Q2 may be formed by the second ellipse.

In addition, the inner circumferential surface 1332 of the cylinder 133 may include a proximal portion 1332*a*, a remote portion 1332*b*, and a curved portion 1332*c*. The proximal portion 1332*a* is a portion closest to the outer circumferential surface 1341 (or the center of rotation) of the roller 134, the remote portion 1332*b* is a portion farthest away from the outer circumferential surface 1342 of the roller 134, and the curved portion 1332*c* is a portion connecting the proximal portion 1332*a* and the remote portion 1332*b*.

The proximal portion 1332*a* may also be defined as the contact point P, and the first quadrant Q1 and the fourth quadrant Q4 may be divided based on the proximal portion 1332*a*. The suction port 1331 may be formed in the first quadrant Q1 and the discharge port 1313 may be formed in the fourth quadrant Q4, based on the proximal portion 1332*a*. Accordingly, when the vane 1351, 1352, 1353 passes the contact point P, a compression surface of the roller 134 in the rotational direction may receive a suction pressure as a low pressure but an opposite compression rear surface may receive a discharge pressure as a high pressure. Then, while passing the contact point P, the roller 134 may receive a greatest fluctuating pressure between a front surface 1351*a*, 1352*a*, 1353*a* of each vane 1351, 1352, 1353 that comes in contact with the inner circumferential surface of the cylinder 133 and a rear end surface 1351*b*, 1352*b*, 1353*b* of each vane 1351, 1352, 1353 that faces back pressure chamber 1344*a*, 1344*b*, 1344*c*. This may cause tremor of the vane 1351, 1352, 1353 significantly.

Referring to FIGS. 1 to 3, the roller 134 according to this embodiment may be rotatably disposed in the compression space V of the cylinder 133, and the plurality of vanes 1351, 1352, 1353 described hereinafter may be inserted into the roller 134 at predetermined intervals along the circumferential direction. Accordingly, the compression space V may be partitioned into as many compression chambers as the number of the plurality of vanes 1351, 1352, and 1353. This embodiment illustrates an example in which the plurality of vanes 1351, 1352, and 1353 is three, and thus, the compression space V is partitioned into three compression chambers V1, V2, and V3.

As described above, the roller 134 may extend integrally from the rotational shaft 123 or may be manufactured separately from the rotational shaft 123 and then post-assembled to the rotational shaft 123. This embodiment will be described based on an example in which the roller is post-assembled to the rotational shaft 123.

However, even when the roller 134 extends integrally from the rotational shaft 123, the rotational shaft 123 and the roller 134 may be formed similarly to those in this embodiment, and the basic operating effects thereof may also be substantially the same as those of this embodiment. However, when the roller 134 is post-assembled to the rotational shaft 123 as in this embodiment, the roller 134 may be formed of a material different from the rotational shaft 123, for example, a material lighter than that of the rotational shaft 123. This may facilitate processing of the roller body 134, and simultaneously reduce a weight of a rotating body including the roller 134, thereby enhancing efficiency of the compressor.

The roller 134 according to this embodiment may be formed as a single body, that is, an integral roller having one roller body (no reference numeral). However, the roller 134 may not be necessarily formed as the integral roller. For example, the roller 134 may be formed as a separable roller that is separated into a plurality of roller bodies (no reference numeral). This will be described hereinafter with respect to another embodiment. In this embodiment, an integral roller 134 configured as a single body will be described as an example.

Referring to FIGS. 1 to 3, the roller 134 according to this embodiment may be formed in an annular shape with a shaft hole 1341 at a center thereof. For example, the roller 134 may have inner and outer circumferential surfaces, and the inner and outer circumferential surfaces of the roller 134 may be formed in a circular shape. However, the inner circumferential surface of the roller 134 may be formed as a continuous seamless surface, whereas the outer circumferential surface of the roller 134 may be formed by discontinuous surfaces which are as many as the number of vane slots 1343*a* because of open surfaces of the vane slots 1343*a*, 1343*b*, 1343*c*, which will be described hereinafter.

Also, a rotational center Or of the roller 134 is coaxially located with an axial center (no reference numeral) of the rotational shaft 123, and the roller 134 rotates concentrically with the rotational shaft 123. However, as described above, as the inner circumferential surface 1332 of the cylinder 133 is formed in the asymmetric elliptical shape biased in a specific direction, the rotational center Or of the roller 134 may be eccentrically disposed with respect to an outer diameter center Oc of the cylinder 133. Accordingly, one side of the outer circumferential surface 1341*b* of the roller 134 may be substantially brought into contact with the inner circumferential surface 1332 of the cylinder 133, precisely, the proximal portion 1332*a*, thereby defining the contact point P.

The contact point P may be formed in the proximal portion 1332*a* as described above. Accordingly, an imaginary line passing through the contact point P may correspond to a minor axis of an elliptical curve defining the inner circumferential surface 1332 of the cylinder 133.

The roller 134 may have the plurality of vane slots 1343*a*, 1343*b*, and 1343*c*, into which the vanes 1351, 1352, and 1353 described hereinafter are slidably inserted, respectively. The plurality of vane slots 1343*a*, 1343*b*, and 1343*c* may be formed at preset or predetermined intervals along the circumferential direction. The outer circumferential surface 1342 of the roller 134 may have open surfaces that are open in the radial direction. Back pressure chambers 1344*a*, 1344*b*, and 1344*c*, which will be described hereinafter, may be formed in inner end portions that are opposite to the open surfaces, so as to have a closed shape in the radial direction.

The plurality of vane slots 1343*a*, 1343*b*, and 1343*c* may be defined as a first vane slot 1343*a*, a second vane slot 1343*b*, and a third vane slot 1343*c* along a compression-progressing direction (the rotational direction of the roller). The first vane slot 1343*a*, the second vane slot 1343*b*, and the third vane slot 1343*c* may be formed at uniform or non-uniform intervals along the circumferential direction.

For example, each of the vane slots 1343*a*, 1343*b*, and 1343*c* may be inclined by a preset or predetermined angle with respect to the radial direction, so as to secure a sufficient length of each of the vanes 1351, 1352, and 1353. Accordingly, when the inner circumferential surface 1332 of the cylinder 133 is formed in the asymmetric elliptical shape, even if a distance from the outer circumferential surface 1342 of the roller 134 to the inner circumferential surface 1332 of the cylinder 133 increases, separation of the vanes 1351, 1352, and 1353 from the vane slots 1343*a*, 1343*b*, and 1343*c* may be suppressed or prevented, which may result in enhancing design freedom for the inner circumferential surface 1332 of the cylinder 133 as well as that of the roller 134.

A direction in which the vane slots 1343*a*, 1343*b*, and 1343*c* are inclined may be a reverse direction to the rotational direction of the roller 134. That is, the front surfaces 1351*a*, 1352*a*, and 1353*a* of the vanes 1351, 1352, and 1353 in contact with the inner circumferential surface 1332 of the cylinder 133 may be tilted toward the rotational direction of the roller 134. This may be advantageous in that a compression start angle may be formed ahead in the rotational direction of the roller 134 so that compression may start quickly.

The back pressure chambers 1344*a*, 1344*b*, and 1344*c* may be formed to communicate with inner ends of the vane slots 1343*a*, 1343*b*, and 1343*c*, respectively. The back pressure chambers 1344*a*, 1344*b*, and 1344*c* may be spaces in which oil (or refrigerant) of discharge pressure or intermediate pressure is filled to flow toward rear sides of the vanes 1351, 1352, and 1353, that is, rear end surfaces 1351*c*, 1352*c*, and 1353*c* of the vanes 1351, 1352, 1353. The vanes 1351, 1352, and 1353 may be pressed toward the inner circumferential surface of the cylinder 133 by the pressure of the oil (or refrigerant) filled in the back pressure chambers 1344*a*, 1344*b*, and 1344*c*. Hereinafter, a direction toward the inner circumferential surface of the cylinder based on a motion direction of the vane may be defined as the front, and an opposite side to the direction may be defined as the rear.

Although not illustrated, the plurality of vane slots 1343*a*, 1343*b*, and 1343*c* may be formed in the radial direction, that is, radially with respect to the rotational center Or of the roller 134. Operating effects to be obtained by the configuration are similar to those in the following embodiment in which the plurality of vane slots 1343*a*, 1343*b*, and 1343*c* are inclined with respect to the rotational center Or of the roller 134, which will be described hereinafter, so description thereof will be the same as the description of the embodiment hereinafter.

A second outflow guide portion (guide) 142 defining a part or portion of residual refrigerant outflow passage 140 described hereinafter may be formed in the roller 134. A plurality of the second outflow guide portion 142 may be provided disposed between the vane slots [(1343*a*, 1343*b*), (1343*b*, 1343*c*), (1343*c*, 1343*a*)] adjacent to each other in the circumferential direction, respectively. A first end 142*a* of the second outflow guide portion 142 may periodically communicate with a second end 1412*b* of a second guide groove 1412 of the first outflow guide portion 1412, and a second end 142*b* of the second outflow guide portion 142 may periodically communicate with a first end 143*a* of the third outflow guide portion 143 described hereinafter. The second outflow guide portion 142 will be described again hereinafter along with the residual refrigerant outflow passage 140.

The back pressure chambers 1344*a*, 1344*b*, and 1344*c* may be hermetically sealed by the main bearing 131 and the sub bearing 132. The back pressure chambers 1344*a*, 1344*b*, and 1344*c* may independently communicate with each of the back pressure pockets [1315*a*, 1315*b*], [1325*a*, 1325*b*], and may also communicate with each other through the back pressure pockets [1315*a*, 1315*b*], [1325*a*, 1325*b*].

Referring to FIGS. 1 to 3, a plurality of vanes 1351, 1352, and 1353 according to this embodiment may be slidably inserted into the respective vane slots 1343*a*, 1343*b*, and 1343*c*. Accordingly, the plurality of vanes 1351, 1352, and 1353 may have substantially a same shape as the respective vane slots 1343*a*, 1343*b*, and 1343*c*.

For example, the plurality of vanes 1351, 1352, 1353 may be defined as first vane 1351, second vane 1352, and third vane 1353 along the rotational direction of the roller 134. The first vane 1351 may be inserted into the first vane slot 1343*a*, the second vane 1352 into the second vane slot 1343*b*, and the third vane 1353 into the third vane slot 1343*c*, respectively.

The plurality of vanes 1351, 1352, and 1353 may have substantially the same shape. For example, the plurality of vanes 1351, 1352, and 1353 may each be formed in a substantially rectangular parallelepiped shape, and the front surfaces 1351*a*, 1352*a*, 1353*a* of the vanes 1351, 1352, and 1353 in contact with the inner circumferential surface 1332 of the cylinder 133 may be curved in the circumferential direction. Accordingly, the front surfaces 1351*a*, 1352*a*, and 1353*a* of the vanes 1351, 1352, and 1353 may come into line-contact with the inner circumferential surface 1332 of the cylinder 133, thereby reducing friction loss.

On the other hand, the sub bearing 132, the roller 134, and the main bearing 131 may communicate with a residual space S, thereby defining a residual refrigerant outflow passage 140 through which refrigerant remaining in the residual space S may flow into the inner space 110*a* of the casing 110.

The residual refrigerant outflow passage 140 may include the first outflow guide portion 141 disposed in the sub bearing 132, the second outflow guide portion 142 disposed in the roller 134, and the third outflow guide portion 143 disposed in the main bearing 131. The first outflow guide portion 141, the second outflow guide portion 142, and the third outflow guide portion 143 may be formed to communicate with one another in a sequential manner. Accordingly, the refrigerant remaining in the residual space S may flow into the inner space 110*a* of the casing 110 sequentially through the first outflow guide portion 141, the second outflow guide portion 142, and the third outflow guide portion 143. The residual refrigerant outflow passage 140 will be described hereinafter.

In the vane rotary compressor having the hybrid cylinder, when power is applied to the drive motor 120, the rotor 122 of the drive motor 120 and the rotational shaft 123 coupled to the rotor 122 rotate together, causing the roller 134 coupled to the rotational shaft 123 or integrally formed therewith to rotate together with the rotational shaft 123. Then, the plurality of vanes 1351, 1352, and 1353 may be drawn out of the vane slots 1343*a*, 1343*b*, and 1343*c* by centrifugal force generated by the rotation of the roller 134 and back pressure of the back pressure chambers 1344*a*, 1344*b*, and 1344*c*, which support the rear end surfaces 1351*b*, 1353*b*, 1353*b* of the vanes 1351, 1352, and 1353, thereby being brought into contact with the inner circumferential surface 1332 of the cylinder 133.

Then, the compression space V of the cylinder 133 may be partitioned by the plurality of vanes 1351, 1352, and 1353 into as many compression chambers (including a suction chamber or a discharge chamber) V1, V2, and V3 as the number of the vanes 1351, 1352, and 1353. The compression chambers V1, V2, and V3 may be changed in volume by the shape of the inner circumferential surface 1332 of the cylinder 133 and eccentricity of the roller 134 while moving in response to the rotation of the roller 134. Accordingly, refrigerant suctioned into the respective compression chambers V1, V2, and V3 may be compressed while moving along the roller 134 and the vanes 1351, 1352, and 1353, and discharged into the inner space of the casing 110. Such series of processes may be repeatedly carried out.

At this time, as a distance between the inner circumferential surface 1332 of the cylinder 133 and the outer circumferential surface 1322 of the roller 134 is sharply narrowed as approaching the contact point P, the third discharge port 1313*c*, which is the final discharge port, is located at a predetermined distance from the contact point P in the circumferential direction. Accordingly, the residual space S is defined between the third discharge port 1313*c* and the contact point P, and refrigerant which has not been discharged even through the third discharge port 1313*c* remains in the residual space S. This may cause over-compression in the residual space S as described above, thereby reducing compressor efficiency.

Accordingly, in this embodiment, residual refrigerant outflow passage (hereinafter, "outflow passage") 140 which has one (first) end that communicates with a portion between the third discharge port 1313*c* and the contact point P, and another (second) end that communicates with the inner space 110*a* of the casing 110. Accordingly, the refrigerant remaining in the residual space S may flow into the inner space 110*a* of the casing 110 through the outflow passage 140, to thus suppress or minimize the refrigerant remaining in the residual space S, thereby preventing the compressor efficiency from being lowered due to over-compression of the refrigerant.

The outflow passage 140 according to this embodiment may include an inlet formed in a bearing in which any discharge port is not formed, and an outlet formed in a bearing having a discharge port with the roller 134 interposed therebetween. The roller 134 may have an intermediate passage through which the inlet and the outlet of the outflow passage 140 communicate with each other periodically or intermittently. Accordingly, the refrigerant remaining in the residual space S may flow into the inner space 110*a* of the casing 110 sequentially through the inlet of the outflow passage 140, the intermediate passage of the outflow passage 140, and the outlet of the outflow passage 140 when the inlet and the outlet of the outflow passage 140 communicate with each other through the intermediate passage.

For example, when the discharge port 1313*a*, 1313*b*, 1313*c* and the discharge muffler 137 are disposed in the main bearing 131, the inlet of the outflow passage 140 may be formed in the sub bearing 132 and the outlet of the outflow passage 140 may be formed in the main bearing 131. However, when the discharge port and the discharge muffler are disposed in the sub bearing 132, the inlet of the outflow passage 140 may be formed in the main bearing 131 and the outlet of the outflow passage 140 may be formed in the sub bearing 132.

Even when the inlet and the outlet of the outflow passage 140 are formed in the opposite bearings as described above, a basic shape of the outflow passage 140 and its operating effects may be the same. Hereinafter, an example in which the inlet of the outflow passage 140 is formed in the sub bearing 132 and the outlet of the outflow passage 140 is formed in the main bearing 131 will be mainly described.

Figure 4:
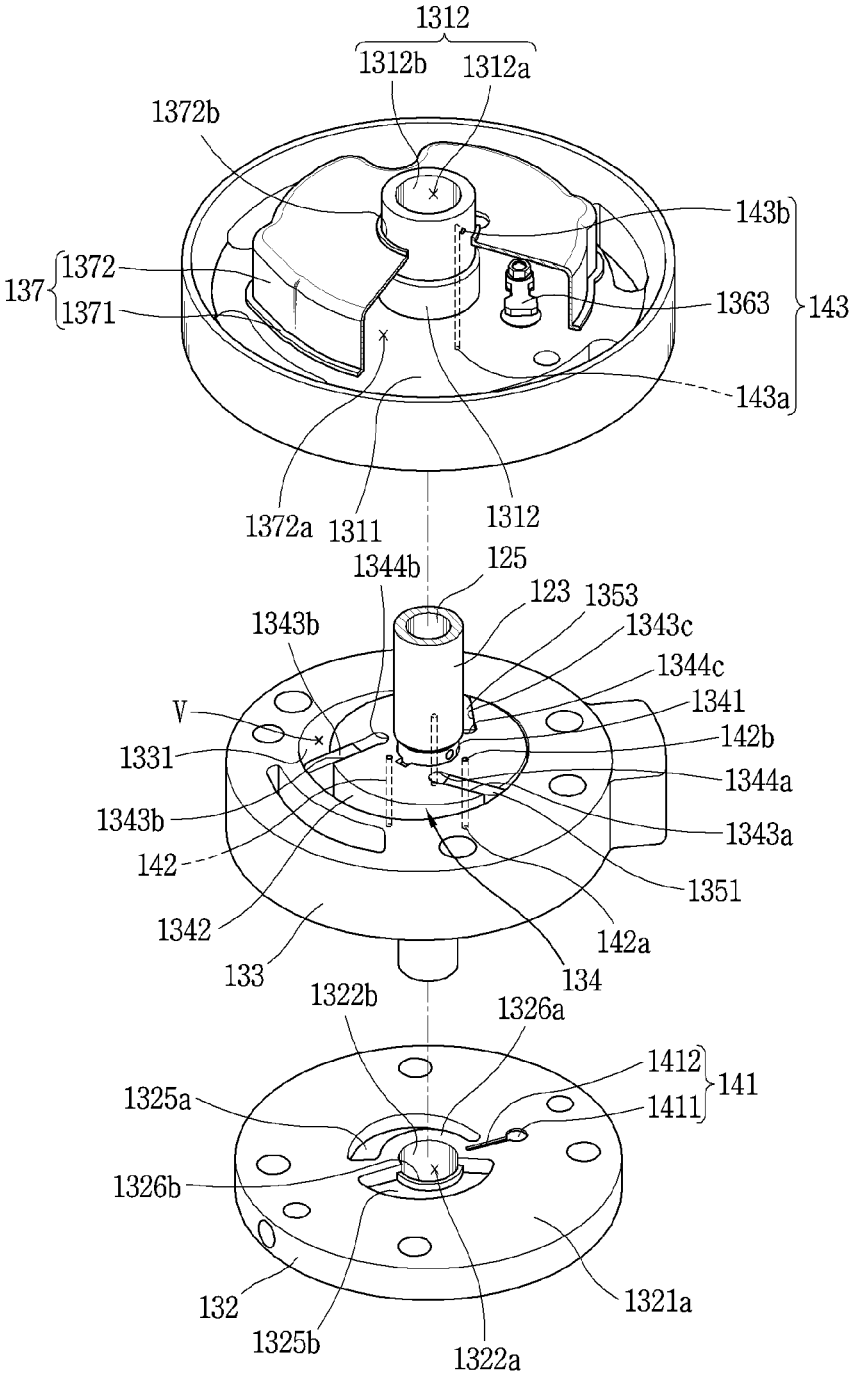
FIG. 4 is a perspective view illustrating an outflow passage by exploding the compression part in FIG. 1.
Figure 5:
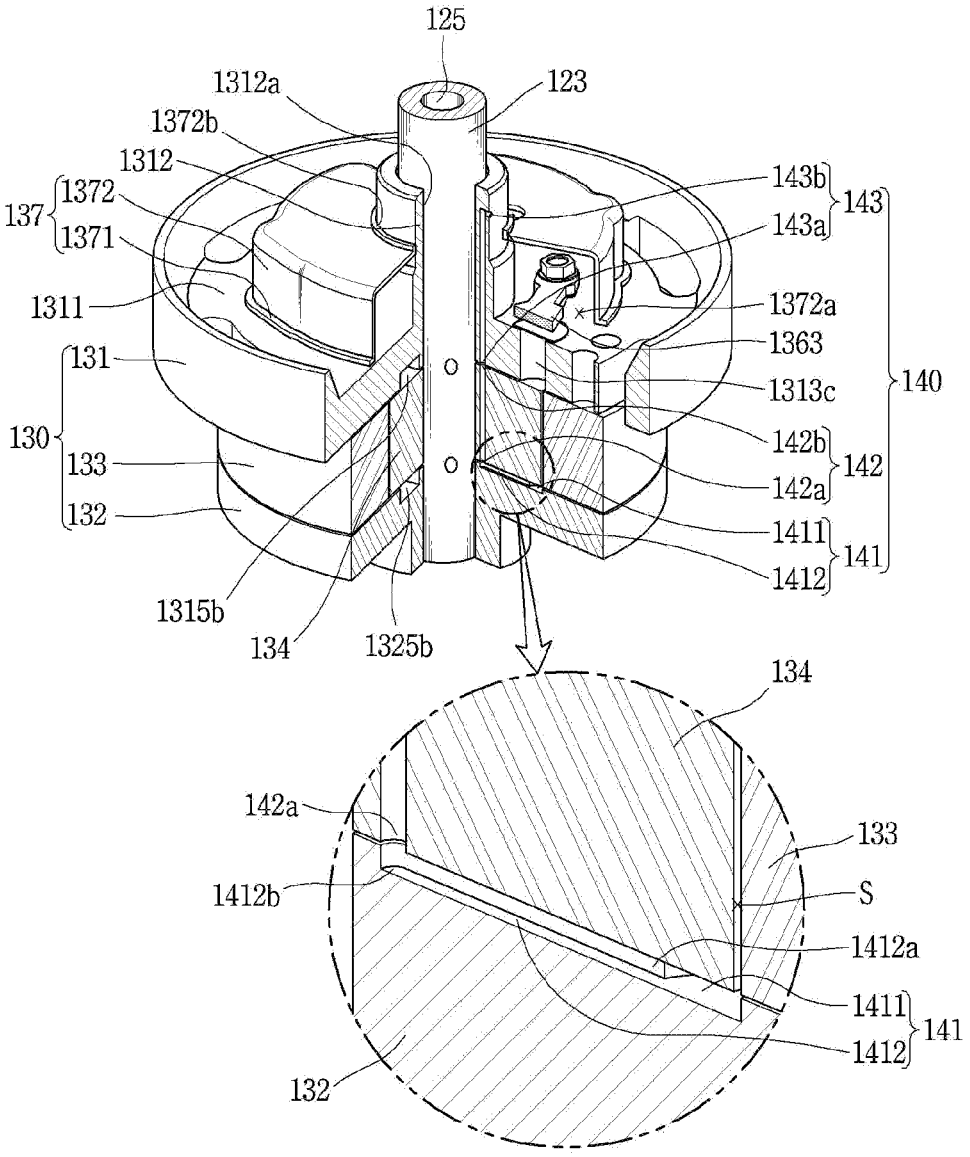
FIG. 5 is a perspective view illustrating an outflow passage by exploding the assembled compression part in FIG. 4.
Figure 6:
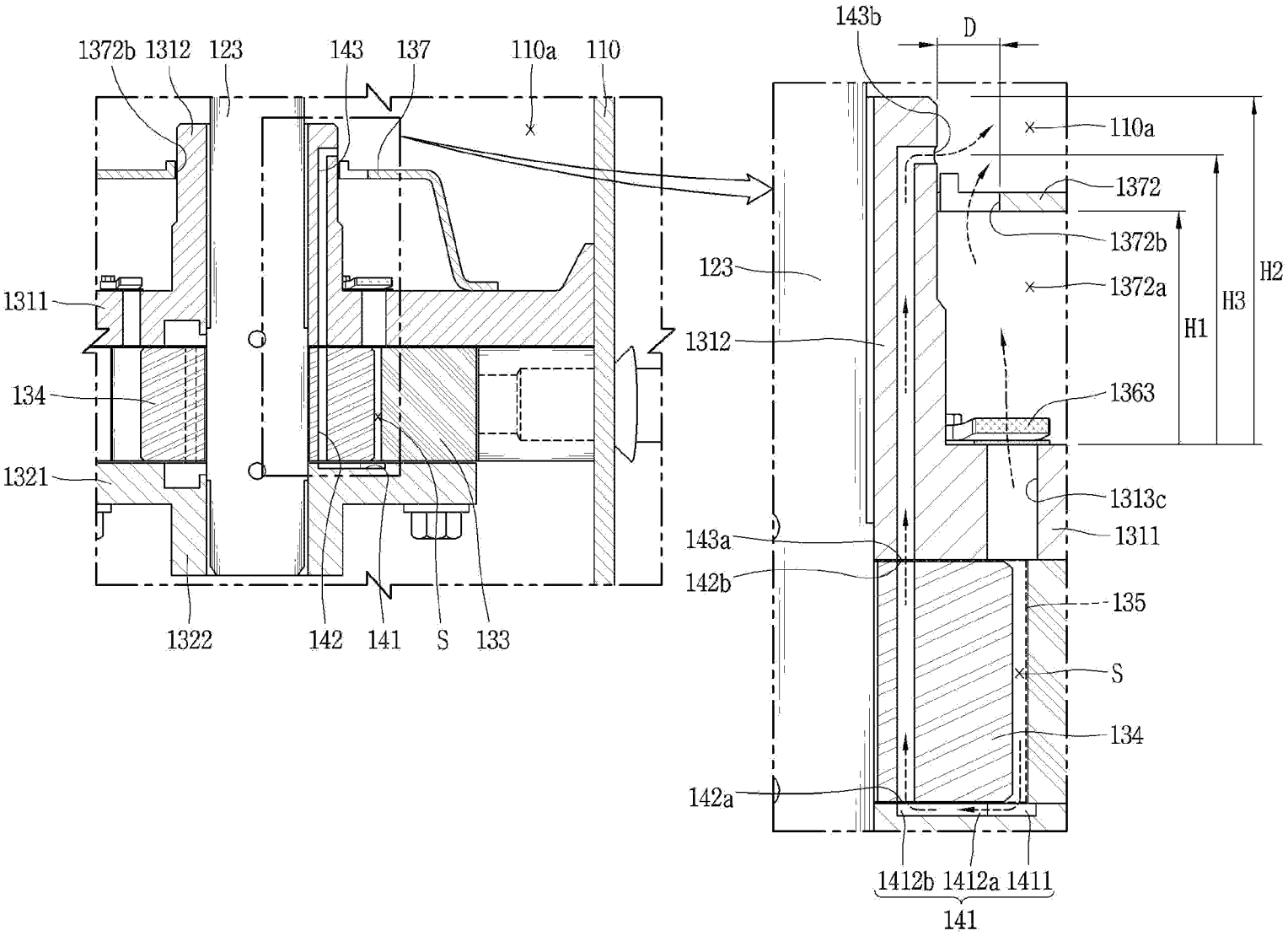
FIG. 6 is a cross-sectional view of the outflow passage in FIG. 5.
Figure 7:
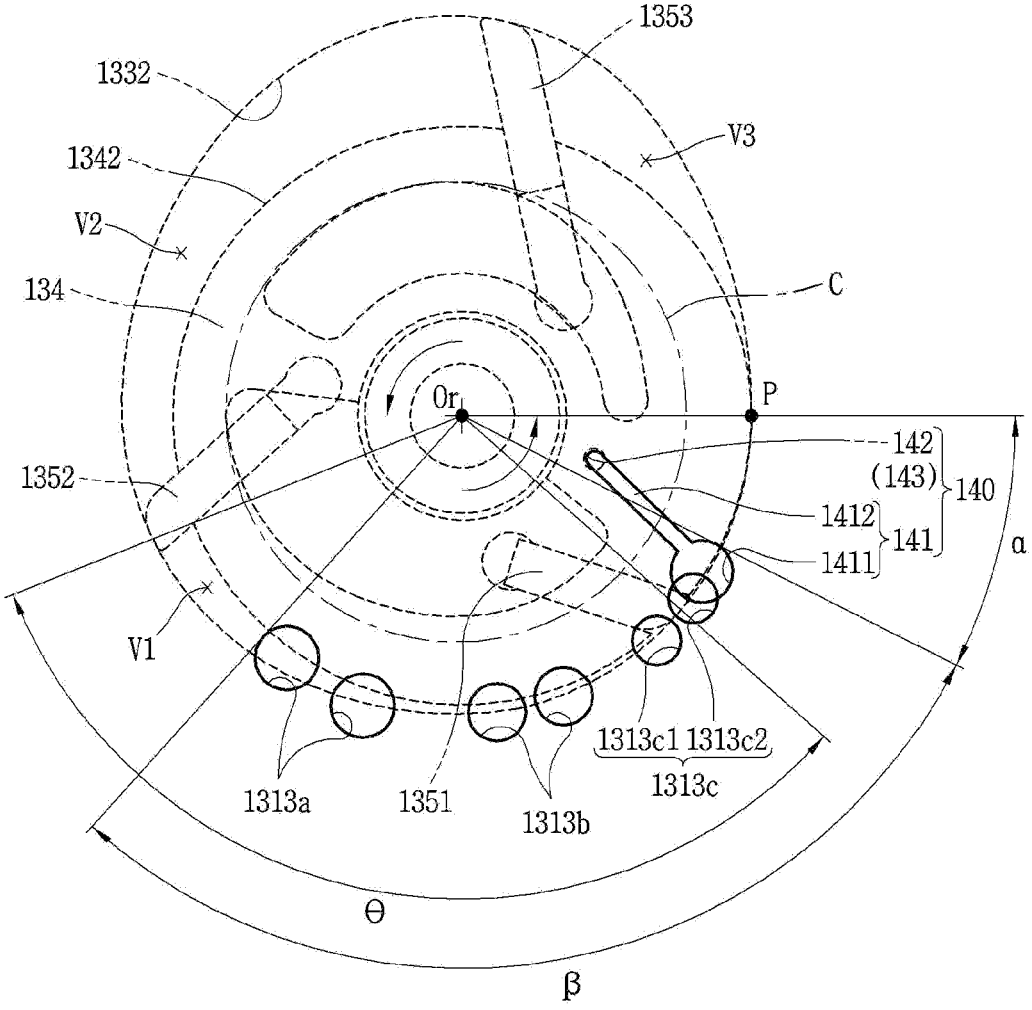
FIG. 7 is a schematic view illustrating a position of a first outflow guide portion in the vane rotary compressor according to FIG. 1.

FIG. 4 is a perspective view illustrating an outflow passage by exploding the compression part in FIG. 1. FIG. 5 is a perspective view illustrating the outflow passage by exploding the assembled compression part in FIG. 4. FIG. 6 is a cross-sectional view of the outflow passage in FIG. 5, and FIG. 7 is a schematic view illustrating a position of a first outflow guide portion in the vane rotary compressor according to FIG. 1.

Referring back to FIG. 1, in the rotary compressor according to this embodiment, the discharge ports 1313*a*, 1313*b*, 1313*c* may be formed through the main plate portion 1311 of the main bearing 131 in the axial direction, discharge valves 1361, 1362, and 1363 that opens and closes the discharge ports 1313*a*, 1313*b*, and 1313*c* may be disposed on one surface of the main plate portion 1311, namely, on an opposite surface to the main sliding surface 1311*a*, and discharge muffler 137 in which the discharge ports 1313*a*, 1313*b*, and 1313*c* and the discharge valves 1361, 1362, and 1363 are accommodated may be disposed on an outer surface of the main bearing 131. Referring to FIGS. 4 to 6, the discharge muffler 137 may include a muffler fixing portion 1371 and a discharge space portion 1372.

The muffler fixing portion 1371 may be formed in a flange shape to be fastened to the outer surface of the main bearing 131, and the discharge space portion 1372 may be formed in a substantially cylindrical shape by extending from an inner circumferential surface of the muffler fixing portion 1371. For example, the muffler fixing portion 1371 may have an outer diameter smaller than an outer diameter of the main plate portion 1311, and include a plurality of bolt holes (no reference numerals) formed in the circumferential direction, such that the discharge muffler 137 may be coupled to the main bearing 131 together with the cylinder 133 and the sub bearing 132 by bolts, for example.

The discharge space portion 1372 may be bent from the muffler fixing portion 1371 and protrude in the axial direction to have a substantially cylindrical shape. Accordingly, an inner surface of the discharge space portion 1372 may be spaced apart from an outer surface of the main plate portion 1311 to define a discharge space 1372*a*. The discharge ports 1313*a*, 1313*b*, and 1313*c* and the discharge valves 1361, 1362, and 1363 may be accommodated in the discharge space 1372*a*.

A height H1 of the discharge space portion 1372 based on an upper surface of the main plate 1311 may be lower than a height H2 of the main bush portion 1312, and a bearing through hole 1372*b* may be formed through a center of the discharge space portion 1372. Accordingly, the discharge space portion 1372 may be engaged with the main bush portion 1312 of the main bearing 131.

An inner circumferential surface of the bearing through hole 1372*b* may be spaced apart from the outer circumferential surface of the main bush portion 1312 by a preset (or predetermined) distance, thereby defining an outflow gap D between the inner circumferential surface of the bearing through hole 1372*b* and the outer circumferential surface of the main bush portion 1312. Accordingly, refrigerant compressed in the compression chambers V1, V2, and V3 is discharged into the discharge space 1372*a* of the discharge muffler 137 through the discharge ports 1313*a*, 1313*b*, and 1313*c*. The refrigerant then flows into the discharge space 110*a* of the casing 110 through the outflow gap D between the inner circumferential surface of the discharge muffler 137 and the outer circumferential surface of the main bush portion 1312. At this time, a pressure pulsation of the refrigerant may be reduced in the discharge space 1372*a*.

Referring to FIGS. 4 to 6, the outflow passage 140 according to this embodiment may include a first outflow guide portion 141, a second outflow guide portion 142, and a third outflow guide portion 143. The first outflow guide portion 141 may be formed in the sub bearing 132, the second outflow guide portion 142 may be formed in the roller 134, and the third outflow guide portion 143 may be formed in the main bearing 131, respectively.

For example, the first outflow guide portion 141 may include a first guide groove 1411 and a second guide groove 1412. The first guide groove 1411 may communicate with the compression space V, more precisely, the residual space S, and the second guide groove 1412 may communicate with the second outflow guide portion 142.

The first guide groove 1411 may have substantially a same shape as the third discharge port 1313*c* which is the final discharge port. For example, the first guide groove 1411 may be formed to have a circular cross-section.

The first guide groove 1411 may be formed at a position at which at least a portion thereof overlaps the third discharge port 1313*c* in the axial direction. For example, when two third discharge ports 1313*c*, namely, a pair of third discharge ports 1313*c* is provided, as illustrated in FIG. 3, the first guide groove 1411 may be located at a position at which at least a portion thereof overlaps a third discharge port (hereinafter, a rear-side third discharge port) 1313*c*2 which is relatively adjacent to the contact point.

Referring to FIG. 7, the first guide groove 1411 may be formed to be located on a same axis as the rear-side third discharge port 1313*c*2 or to be more adjacent to the contact point P than the rear-side third discharge port 1313*c*2. For example, when an end of the rear-side third discharge port 1313*c*2 is located at a position spaced part from the contact point P by a minimum sealing distance (or sealing angle) a, namely, about 5° or more, the first guide groove 1411 may be more eccentric toward the contact point P than the rear-side third discharge port 1313*c*2. In this case, it may be advantageous that the first guide groove 1411 is formed at a position more than about 5° apart from the contact point P so as to secure the minimum sealing distance a. This may suppress or prevent high-pressure refrigerant from flowing into a suction side beyond the contact point P due to the first guide groove 1411.

On the other hand, when the end of the rear-side third discharge port 1313*c*2 is located at the position which is about 5° corresponding to the minimum sealing distance a apart from the contact point P, the first guide groove 1411 may be located on the same axis as the rear-side third discharge port 1313*c*2. Even in this case, the high-pressure refrigerant may be suppressed or prevented from flowing into a suction side beyond the contact point P due to the first guide groove 1411.

In addition, the first guide groove 1411 may be formed to overlap the rear-side third discharge port 1313*c*2 in the axial direction by about 50% or more of a total area of the first guide groove 1411. Accordingly, an area where the first guide groove 1411 overlaps the aforementioned residual space S in the axial direction may increase, so that the residual refrigerant may effectively flow out.

A discharge passage arcuate angle β according to this embodiment may be larger than or equal to an angle θ between vanes, and may be larger than the angle θ between the vanes. FIG. 7 illustrates that the discharge passage arcuate angle β is smaller than the angle θ between the vanes. However, when the first guide groove 1411 is formed in an elongated rectangular shape in the circumferential direction, the discharge passage arcuate angle β may be larger than or equal to the angle θ between the vanes.

The discharge passage arcuate angle β may be defined as an arcuate angle between a start end of the first discharge port 1313*a*, which is the first discharge port, and an end of the first guide groove 1411 located beyond the third discharge port 1313*c*, which is the final discharge port, and the angle θ between the vanes may be defined as an arcuate angle between neighboring vanes (i.e., (1351 and 1352) (1352 and 1353), and (1353*c* and 1351) when the three vanes 1351, 1352, and 1353 are disposed at equal intervals in the circumferential direction of the roller 134.

In this case, the angle θ between the vanes may be 120°, and the discharge passage arcuate angle β may be approximately larger than or equal to 120°, and may be larger than 120°. Accordingly, the discharge passage including the discharge port and the outflow passage 140 may extend to a circumferential range of a corresponding compression chamber or to outside of the circumferential range of the compression chamber. Then, a length of a discharge stroke for refrigerant in the compression chamber may be secured longer than a length of a compression stroke, which may result in minimizing an amount of compressed refrigerant which remains in the compression chamber after the discharge stroke or in the residual space S adjacent to the contact point P. In addition, as an arcuate length of the discharge passage is longer than or equal to an arcuate length of the compression chamber, a continuous discharge may be achieved, thereby reducing a pressure pulsation.

Also, the first guide groove 1411 may have a cross-sectional area that is greater than or equal to that of the rear-side third discharge port 1313*c*2. This may increase an area of the first guide groove 1411 that overlaps the residual refrigerant, so that the residual refrigerant may be more effectively exhausted. However, the first guide groove 1411 may have a cross-sectional area which is smaller than that of the rear-side third discharge port 1313*c*2.

Although not illustrated, the first guide groove 1411 may be formed in various shapes. For example, in FIGS. 4 to 8, only one first guide groove 1411 is formed, but in some cases, two first guide groove 1411 may be provided as a pair, like the third discharge ports, to communicate with each other or to be formed in the form of a single long groove. In this case, the first guide groove 1411 may be elongated in the circumferential direction such that the residual refrigerant may be more effectively exhausted.

Referring to FIGS. 4 to 6, a first end 1412*a* of the second guide groove 1412 may communicate with the first guide groove 1411, and a second end 1412*b* of the second guide groove 1412 may communicate with the second outflow guide portion 142. For example, the second guide groove 1412 may be formed in a rectangular shape extending lengthwise in the radial direction.

More specifically, the first end 1412*a* of the second guide groove 1412 may be located radially outward, and the second end 1412*b* of the second guide groove 1412 may be located radially inward. Accordingly, the second end 1412*b* of the second guide groove 1412 may be located closer to the rotational center Or of the roller 134 than the first guide groove 1411.

A cross-sectional area (or width) of the second guide groove 1412 may be smaller than an inner diameter of the first guide groove 1411. For example, the second guide groove 1412 may be thinner and longer than the first guide groove 1411. Accordingly, a portion of the second guide groove 1412 may be located between the first sub back pressure pocket 1325*a* and the second sub back pressure pocket 1325*b*. For example, the first end 1412*a* of the second guide groove 1412 may be located outside of a pocket virtual circle C connecting the outer circumferential surface of the first sub back pressure pocket 1325*a* and the outer circumferential surface of the second sub back pressure pocket 1325*b*. On the other hand, the second end 1412*b* of the second guide groove 1412 may be located between the first sub back pressure pocket 1325*a* and the second sub back pressure pocket 1325*b* in the circumferential direction.

The second guide groove 1412 may have a cross-sectional area which is greater than or equal to a cross-sectional area of the second outflow guide portion 142 on the same axis as the second outflow guide portion 142 described hereinafter. Accordingly, the second guide groove 1412 may periodically communicate with the second outflow guide portion 142 provided in the roller 134 when the roller 134 rotates.

Referring to FIGS. 4 to 6, the second outflow guide portion 142 according to this embodiment may be formed through both axial side surfaces of the roller 134. For example, the first end 142*a* of the second outflow guide portion 142 may be open to a lower surface of the roller 134 facing the sub-sliding surface 1321*a*, and the second end 142*b* of the second outflow guide portion 142 may be open to an upper surface of the roller 134 facing the main bearing surface 1312*b*.

The second outflow guide portion 142 may be formed through the roller 134 in the axial direction. Accordingly, the second outflow guide portion 142 may be easily processed. However, the second outflow guide portion 142 does not necessarily have to be formed through the roller 134 in the axial direction.

Although not illustrated, the second outflow guide portion 142 may be inclined with respect to the axial direction, for example, may be inclined in a forward direction with respect to the rotational direction of the roller 134 from the first end 142*a* to the second end 142*b* of the second outflow guide portion 142. In this case, the refrigerant of the first outflow guide portion 141 may flow out more rapidly by receiving centrifugal force while passing through the second outflow guide portion 142.

The second outflow guide portion 142 may be located at a position at which it overlaps the second guide groove 1412 of the first outflow guide portion 141 in the axial direction. Accordingly, when the roller 134 rotates, the second outflow guide portion 142 may periodically communicate with the second guide groove 1412 of the first outflow guide portion 141.

The second outflow guide portion 142 may be one or more in number. For example, the number of the second outflow guide portions 142 may be greater than the number of the first outflow guide portions 141, more precisely, the number of the second guide grooves 1412. Accordingly, the second outflow guide portion 142 may communicate with the second guide groove 1412 per rotation of the roller 134 a plurality of times, to be precise, as many times as the number of the second outflow guide portions 142. The first outflow guide portion 141 including the second guide groove 1412 may communicate with the third outflow guide portion 143 once per rotation of the roller 134.

The second outflow guide portion 142 may be provided to correspond to the number of vanes 135 (or the number of compression chambers), and each of the first outflow guide portion 141 and the third outflow guide portion 143 may be one in number. In other words, the first outflow guide portion 141 and the third outflow guide portion 143 may be located on a same axis, and the second outflow guide portions 142 may be disposed at equal intervals along the circumferential direction, for example, may be disposed at intervals of 120° along the circumferential direction when there are three vanes 135. Accordingly, the second outflow guide portions 142 may allow the first outflow guide portion 141 and the third outflow guide portion 143 to communicate with each other at every 120° based on a rotational angle of the roller 134 (or rotational shaft).

The outflow passage 140 may be open once every 120° so that the residual refrigerant without flowing out of each of the compression chambers V1, V2, and V3 may flow into the inner space 110*a* of the casing 110 through the second outflow guide portion 142. Accordingly, during the compression stroke, the outflow passage 140 may be blocked to prevent the refrigerant, which is being compressed, from flowing out through the outflow passage 140. This may suppress or prevent an occurrence of insufficient compression due to the outflow passage 140 in advance.

Although not illustrated, the second outflow guide portion 142 may be provided as a plurality between the neighboring vanes (i.e., (1351 and 1352), (1352 and 1353), and (1353 and 1351)), that is, in each of the compression chambers V1, V2, and V3. Even in this case, the residual refrigerant flowing out of each of the compression chambers V1, V2, and V3 may be discharged through each of the second outflow guide portions 142.

The second outflow guide portion 142 may be formed in the same number or in the same cross-sectional area in each of the compression chambers V1, V2, and V3. Accordingly, the residual refrigerant without flowing out of each compression chamber may be equally discharged.

The second outflow guide portion 142 may have an inner diameter which is greater than or equal to a width of the second guide groove 1412. Therefore, the refrigerant passing through the second guide groove 1412 of the first outflow guide portion 141 may be freely guided to the second outflow guide portion 142, so as to be quickly emitted.

Referring to FIGS. 4 to 6, the third outflow guide portion 143 according to this embodiment may be formed through between both axial side surfaces of the main bearing 131. For example, a first end 143*a* of the third outflow guide portion 143 may be open to the main sliding surface 1311*a* of the main plate portion 1311, and a second end 143*b* of the third outflow guide portion 143 may be open to an outer circumferential surface of the main bush portion 1312.

The third outflow guide portion 143 may communicate with the second guide groove 1412 of the first outflow guide portion 141 through the second outflow guide portion 142. For example, when the second outflow guide portion 142 penetrates in the axial direction, the first end 143*a* of the third outflow guide portion 143 may be located on the same axis as a second end 1412*b* of the second guide groove 1412.

Although not illustrated, when the second outflow guide portion 142 is formed to be inclined, the first end 143*a* of the third outflow guide portion 143 may communicate with the second end 142*b* of the second outflow guide portion 142 at a time point at which the first end of the second outflow guide portion 142 communicates with the second end 1412*b* of the second guide groove 1412. For example, the first end 143*a* of the third discharge guide portion 143 may be located between the first main back pressure pocket 1315*a* and the second main back pressure pocket 1315*b* in the circumferential direction. Accordingly, the second outflow guide portion 142 may be formed through the main bush portion 1312 in the axial direction.

Although not illustrated, the first end 143*a* of the third outflow guide portion 143 may alternatively be formed more outward than a pocket virtual circle C at which the outer circumferential surface of the first main back pressure pocket 1315*a* is connected to the outer circumferential surface of the second main back pressure pocket 1315*b*. In this case, the second outflow guide portion 142 may be formed through the main bush portion 1312 to be inclined with respect to the axial direction, or formed axially through a guide protrusion (not illustrated) that extends from the outer circumferential surface of the main bush portion 1312 in the radial direction.

The third outflow guide portion 143 may be formed to be less than the second outflow guide portion 142 in number. For example, the third discharge guide portion 143 and the first discharge guide portion 141 may be one each in number, to be located on a same axis. In this case, the second outflow guide portions 142 may be provided as many as the number of compression chambers V1, V2, and V3, namely, provided as three in number to be disposed at equal intervals along the circumferential direction, and may be disposed on a same axis as each of the second discharge guide portions 142. Accordingly, the third outflow guide portion 143 may communicate with the first outflow guide portion 141 once per rotation of the roller 134.

Although not illustrated, the number of the third outflow guide portion 143 may be different from the number of the first outflow guide portion 141. For example, the third outflow guide portion 143 may be provided as one in number and the first outflow guide portion 141 may be provided in plurality. Conversely, the third outflow guide portion 143 may be provided as a plurality and the first outflow guide portion 141 may be provided as one in number. However, even in these cases, the third outflow guide portion 143 may be formed on the same axis with each of the second outflow guide portions 142, and may communicate with the first outflow guide portion 141 once per rotation of the roller 134.

The third outflow guide portion 143 may have an inner diameter which is greater than or equal to that of the second guide groove 142. For example, a cross-sectional area of the first end 143*a* of the third outflow guide portion 143 may be greater than or equal to a cross-sectional area of the second end 142*b* of the second outflow guide portion 142. Therefore, the refrigerant passing through the second outflow guide portion 142 may be freely guided to the third outflow guide portion 143, so as to be quickly exhausted.

The second end 143*b* of the third outflow guide portion 143 may be open from the outer circumferential surface of the main bush portion 1312 toward the inner space 110*a* of the casing 110. For example, a height H3 of the second end 143*b* of the third outflow guide portion 143 based on an upper surface of the main plate portion 1311 may be higher than a height H1 of the discharge space portion 1372 of the discharge muffler 137. In other words, the second end 143*b* of the third outflow guide portion 143 may be open to the outer circumferential surface of the main bush portion 1312 at a position higher than the discharge space portion 1372 of the discharge muffler 137. Accordingly, the refrigerant passing through the third outflow guide portion 143 may directly flow into the inner space 110*a* of the casing 110 without passing through the discharge space 1372*a* of the discharge muffler 137. With this configuration, the refrigerant may suppress or prevent an increase in internal pressure of the discharge muffler 137, so that the discharge valve 1361, 1362, 1363 may be quickly opened, and at the same time, a vortex phenomenon in the discharge space 1372*a* may be suppressed or prevented so that the refrigerant may be quickly discharged through the discharge port 1313*a*, 1313*b*, 1313*c*.

In addition, as the second end 143*b* of the third outflow guide portion 143 is open to the outer circumferential surface of the main bush portion 1312, the refrigerant that flows into the inner space 110*a* of the casing 110 through the third outflow guide portion 143 may be smoothly guided into a gap between the inner circumferential surface of the stator 121 and the inner circumferential surface of the rotor 122, an inner gap of the stator 121, or a gap between the outer circumferential surface of the stator 121 and the inner circumferential surface of the casing 110, so as to quickly move toward the discharge pipe 116.

Although not illustrated, the second end 143*b* of the third outflow guide portion 143 may be open to the upper surface of the main bush portion 1312. In this case, as the third outflow guide portion 143 is formed by single processing, the third outflow guide portion 143 may be easily processed.

Hereinafter, an operating effect of the rotary compressor according to this embodiment will be described.

Referring back to FIG. 3, as the vanes 1351, 1352, and 1353 rotate together with the roller 134, the corresponding compression chambers V1, V2, and V3 may sequentially pass through the discharge ports 1313*a*, 13131*b*, and 1313*c* while moving from the first discharge port 1313*a* to the third discharge port 1313*c*. At this time, most of the refrigerant compressed in the corresponding compression chambers V1, V2, and V3 may be discharged into the discharge space 1372*a* of the discharge muffler 137 through the respective discharge ports 1313*a*, 13131*b*, and 1313*c*, so as to flow into the inner space 110*a* of the casing 110. However, the refrigerant may partially remain in the residual space S between the third discharge port 1313*c* and the contact point P without being discharged through the third discharge port 1313*c*.

Accordingly, in this embodiment, the outflow passage 140 may be provided at a position beyond the third discharge port 1313 such that the refrigerant remaining in the residual space S may flow into the inner space 110*a* of the casing 110. In other words, as in this embodiment, when the first outflow guide portion 141 defining the portion of the outflow passage 140 is formed at a position overlapping the rear-side third discharge port 1313*c*2 of the third discharge port 1313*c* as the final discharge port or the residual space S, the refrigerant remaining in the residual space S may directly flow into the inner space 110*a* of the casing 110 through the outflow passage 140 configured by the first outflow guide portion 141, the second outflow guide portion 142 and the third outflow guide portion 143. This may minimize that high-pressure refrigerant remains in the residual space S, thereby lowering a motor input or suppressing or preventing an unstable behavior of the vane.

Figure 8A:
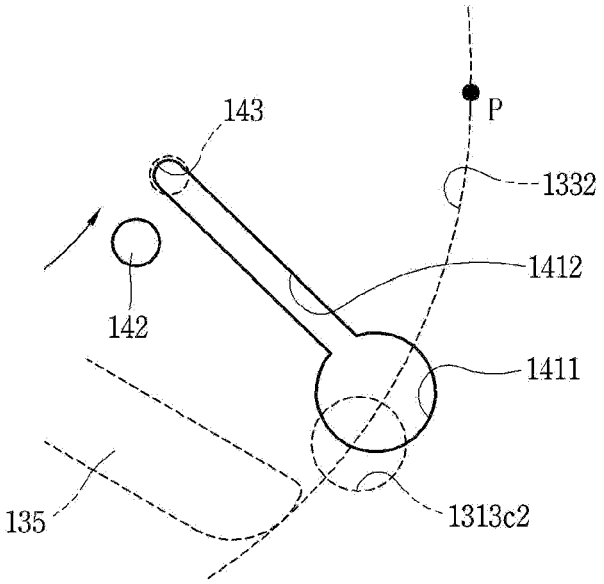
FIGS. 8A to 8C are schematic views illustrating a process in which residual refrigerant flows out through an outflow passage in accordance with an embodiment.
Figure 8B:
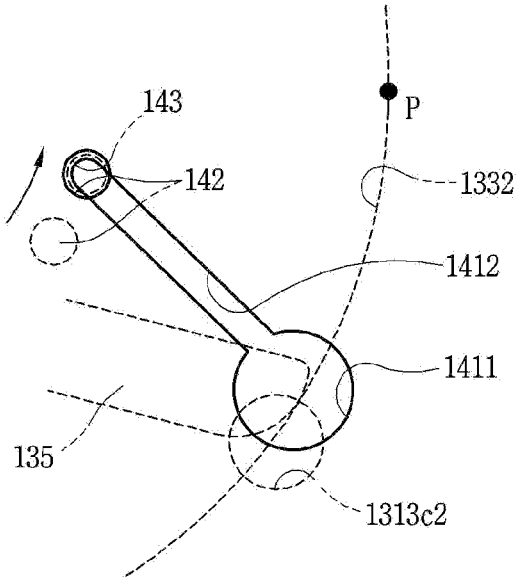
Figure 8C:
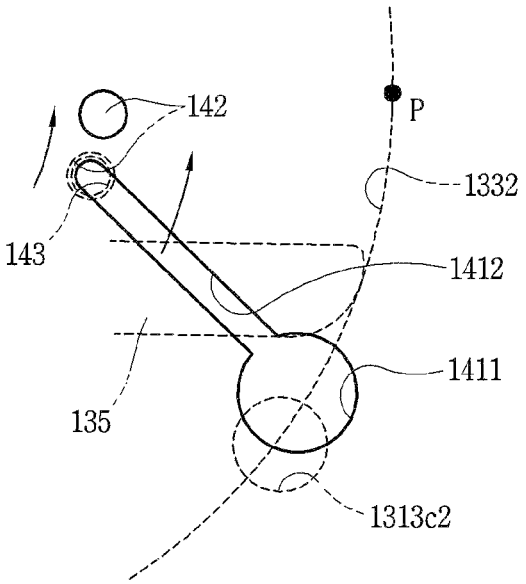

FIGS. 8A to 8C are schematic views illustrating a process in which residual refrigerant flows out through an outflow passage in accordance with an embodiment. For convenience of explanation, FIGS. 8A to 8C illustrates that the second guide groove, the second outflow guide portion, and the third outflow guide portion have different inner diameters. However, the second guide groove, the second outflow guide portion, and the third outflow guide portion may have the different inner diameters as illustrated, or have the same inner diameter.

FIG. 8A illustrates a state in which the vane 135 has reached a position adjacent to the third discharge port 1313*c*, in response to the rotation of the roller 134. In this state, the vane 135 is still in the course of passing through the third discharge port 1313*c*. Therefore, the third discharge port 1313*c* is still open, and accordingly, the residual space S communicating with the third discharge port 1313*c* is kept open without being sealed. At this time, the second outflow guide portion 142 provided in the roller 134 becomes a non-communicated state in which it has not yet arrived at a position between the first outflow guide portion 141 of the sub bearing 132 and the third outflow guide portion 143 of the main bearing 131. Then, refrigerant in the residual space S is discharged, together with refrigerant of the corresponding compression chamber, into the inner space 110*a* of the casing 110 through the third discharge port 1313*c* before the refrigerant passes through the rear-side third discharge port 1313*c*2 defining the third discharge port 1313*c*.

FIG. 8B illustrates a state in which the vane 135 has just passed through the third discharge port 1313*c*, in response to further rotation of the roller 134. In this state, the corresponding vane 135 is located between the third discharge port 1313*c* and the residual space S, and the residual space S is separated from the third discharge port 1313*c* and sealed. At this time, the second outflow guide portion 142 provided in the roller 134 is in a communicated state in which it has arrived at the position between the first outflow guide portion 141 of the sub bearing 132 and the third outflow guide portion 143 of the main bearing 131. Accordingly, the refrigerant remaining in the residual space S may flow into the inner space 110*a* of the casing 110 sequentially through the first outflow guide portion 141, the second outflow guide portion 142, and the third outflow guide portion 143. Accordingly, even if the refrigerant partially remains in the residual space S because the residual space S is sealed, the residual refrigerant may move into the inner space 110*a* of the casing 110 through the outflow passage 140. This may suppress or prevent the high-pressure refrigerant from remaining in the residual space S.

FIG. 8C illustrates a state in which the vane 135 has almost reached the contact point P through the third discharge port 1313*c*, in response to further rotation of the roller 134. In this state, a preceding vane has already passed through the third discharge port 1313*c* but a succeeding vane has not yet arrived at the third discharge port 1313*c*, so the third discharge port 1313*c* is in the open state. Accordingly, the residual space S connected to the third discharge port 1313*c* is also not sealed and maintained in the open state. At this time, the second outflow guide portion 142 provided in the roller 134 is in a non-communicated state in which it has passed through the position between the first outflow guide portion 141 of the sub bearing 132 and the third outflow guide portion 143 of the main bearing 131. Then, refrigerant in the residual space S is discharged, together with refrigerant of a succeeding compression chamber, into the inner space 110*a* of the casing 110 through the third discharge port 1313*c* before the vane passes through the rear-side third discharge port 1313*c*2 defining the third discharge port 1313*c*.

In this way, the residual refrigerant remaining in the compression space may move into the inner space of the casing even after the discharge stroke, thereby minimizing an amount of refrigerant remaining in the compression space even after the discharge stroke. At the same time, as the outflow passage is periodically opened, leakage of refrigerant may be suppressed or prevented during the compression stroke, resulting in preventing an occurrence of under-compression.

The outflow guide portions may further be provided, in addition to the discharge ports, to configure the discharge passage, so as to increase an effective discharge area for discharging compressed refrigerant into the inner space of the casing. This may allow the refrigerant compressed in the compression chamber to be discharged more rapidly during the discharge stroke, thereby suppressing or preventing over-compression loss.

In addition, high-pressure refrigerant may be suppressed or prevented from remaining in the residual space, and accordingly, pressure acting on the front surface of the vane may be equalized, which may result in resolving a difference in pressure acting on the front and rear surfaces of the vane, thereby suppressing or preventing jumping of the vane. This may also prevent the front surface of the vane or the inner circumferential surface of the cylinder facing the front surface from being worn out and simultaneously reduce vibration noise due to chattering of the vane. This may additionally suppress or prevent the high-pressure refrigerant from flowing into a suction side over the contact point P, thereby reducing suction loss. The discharge passage including the outflow passage may extend to the circumferential range of the compression chamber or to the outside of the circumferential range of the compression chamber, which may allow a continuous discharge during the discharge stroke, thereby lowering a pressure pulsation.

Those effects described above may be more expected in the rotary compressor according to this embodiment when high-pressure refrigerant, such as R32, R410a, or $CO_2$, is used.

Hereinafter, another embodiment of the outflow passage will be described. That is, in the previous embodiment, the inlet of the outflow passage is formed between the discharge port and the residual space, but in some cases, the inlet of the outflow passage may be located at a position ahead of the discharge port.

Figure 9:
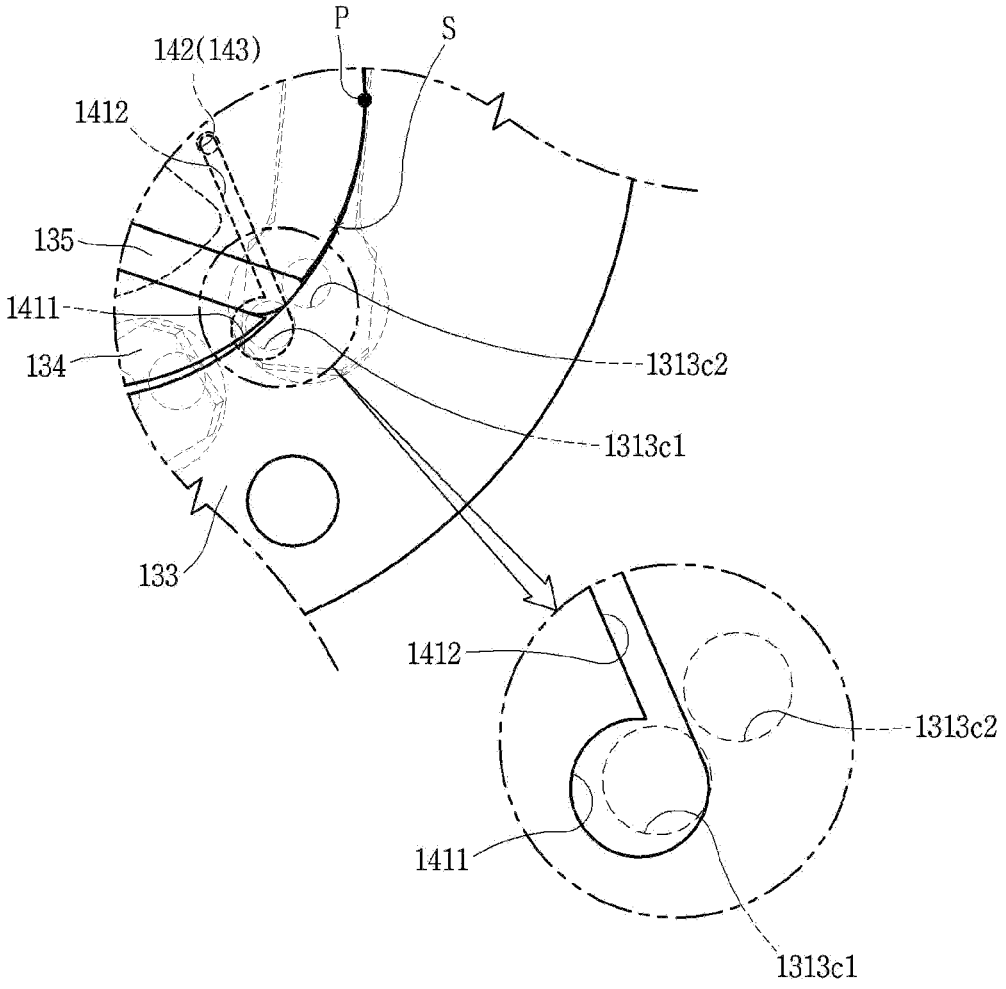
FIG. 9 is a planar view of an outflow passage according to another embodiment.

FIG. 9 is a planar view of an outflow passage according to another embodiment. Referring to FIG. 9, in this embodiment, the outflow passage 140 may include first outflow guide portion 141, second outflow guide portion 142, and third outflow guide portion 143. The basic configuration of the first outflow guide portion 141, the second outflow guide portion 142, and the third outflow guide portion 143 and the effects thereof are the same as those of the previous embodiment, so repetitive description thereof has been omitted.

However, the first outflow guide portion 141 according to this embodiment may include a first guide groove 1411 and a second guide groove 1412, but the first guide groove 1411 may be located at a position ahead of the rear-side third discharge port 1313*c*2 which is the final discharge port. For example, the first guide groove 1411 may be located at a position ahead of a front-side third discharge port 1313*c*1 in the circumferential direction. Accordingly, refrigerant that has passed through the second discharge port 1313*b* may partially flow into the first outflow guide portion 141 constituting the inlet of the outflow passage 140 before moving to the front-side third discharge port 1313*c*1. This refrigerant may then flow in advance into the inner space 110*a* of the casing through the second outflow guide portion 142 and the third outflow guide portion 143.

Even in this case, the first guide groove 1411 may overlap the front-side third discharge port 1313*c*1 by about 50% or more in the axial direction. This may suppress or prevent under-compression of the refrigerant of the corresponding compression chamber due to the outflow passage 140.

As described above, when the first guide groove 1411 of the first outflow guide portion 141 constituting the inlet of the outflow passage 140 is located ahead of the front-side third discharge port 1313*c*1, the third discharge port 1313*c* may have an expanded effective discharge area. Accordingly, refrigerant compressed in the compression chamber may be rapidly discharged even through the outflow passage 140 as well as the third discharge port 1313*c*, and this may result in reducing an amount of refrigerant without being discharged from the compression chamber. With this configuration, an amount of residual refrigerant that moves to the residual space without being discharged from the compression chamber may be reduced, thereby suppressing or preventing motor efficiency from being lowered due to over-compression in the compression space and wear and vibration noise due to chattering of the vane.

Although not illustrated, when the rear-side third discharge port 1313*c*2 is located at a position which is spaced a minimum sealing distance a of 5° or more apart from the contact point P, the first guide groove 1411 may be located at a position ahead of the rear-side third discharge port 1313*c*2, for example, within a section from a position ahead of the front-side third discharge port 1313*c*1 to a position behind the rear-side third discharge port 1313*c*2. Even in these cases, the first guide groove 1411 may be formed to overlap the front-side third discharge port 1313*c*1 or/and the rear-side third discharge port 1313*c*2 by about 50% or more in the axial direction at a position at which it secures the minimum sealing distance. Also, in these cases, the operation effects are similar to those of the previous embodiment, and thus, repetitive description thereof has been omitted.

Hereinafter, an outflow passage according to still another embodiment will be described. That is, the previous embodiments illustrate that the inlet of the outflow passage is located eccentrically at the position ahead of or behind the discharge port, but in some cases, the inlet of the outflow passage may be formed substantially on the same axis as the discharge port.

Figure 10:
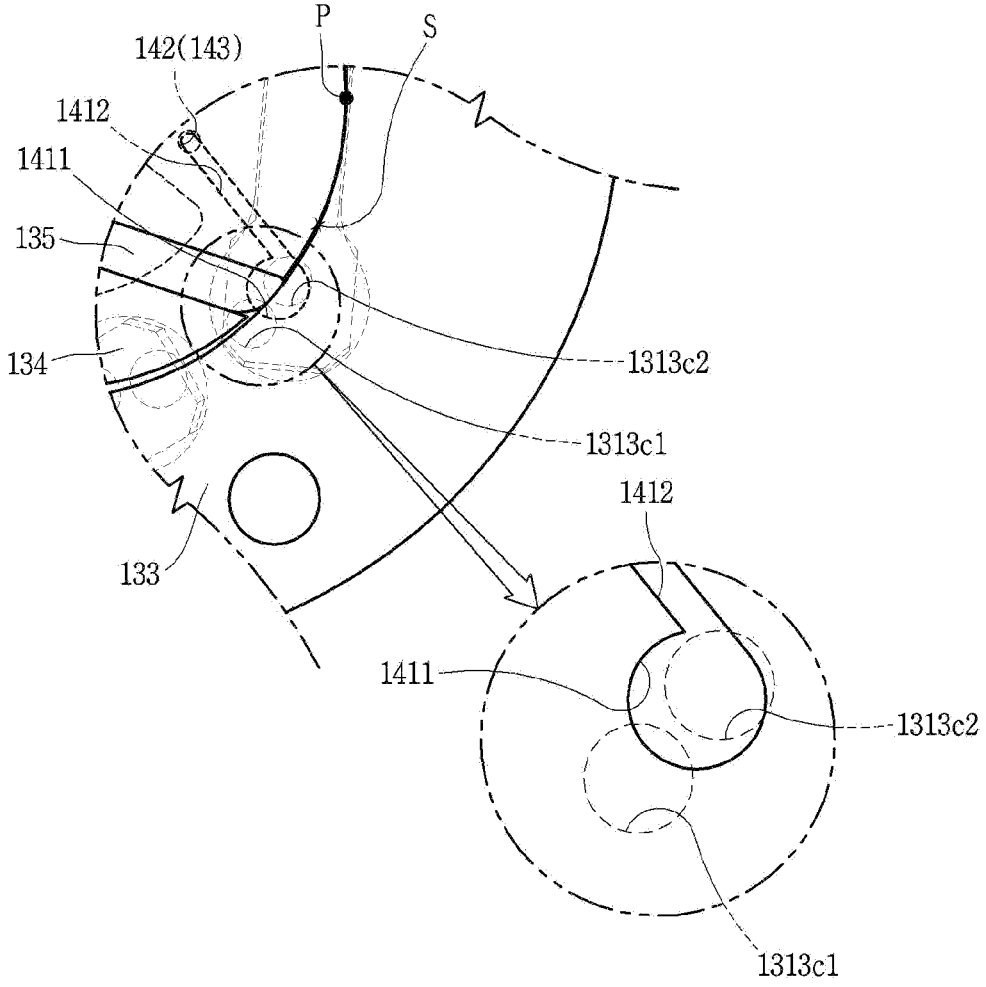
FIG. 10 is a planar view illustrating of an outflow passage according to still another embodiment.

FIG. 10 is a planar view of an outflow passage according to still another embodiment. Referring to FIG. 10, in this embodiment, the outflow passage 140 may include first outflow guide portion 141, second outflow guide portion 142, and third outflow guide portion 143. The basic configuration of the first outflow guide portion 141, the second outflow guide portion 142, and the third outflow guide portion 143 and the effects thereof are the same as those of the previous embodiment, so repetitive description thereof has been omitted.

However, the first outflow guide portion 141 according to this embodiment may include first guide groove 1411 and second guide groove 1412, but at least a portion of the first guide groove 1411 may be located on a same axis as the discharge port 1313*c*, which is the final discharge port. For example, the rear-side third discharge port 1313*c*2 may be located at the position which is spaced 5° corresponding the minimum sealing distance a apart from the contact point P, and the first guide groove 1411 may be located substantially on the same axis as the rear-side third discharge port 1313*c*2.

In this case, the first guide groove 1411 may be located between the rear-side third discharge port 1313*c*2 and the front-side third discharge port 1313*c*1. For example, the first guide groove 1411 may be located at a position which is behind (or on the same axis as) the front-side third discharge port 1313*c*1 but ahead of (or on the same axis as) the rear-side third discharge port 1313*c*2. Therefore, the first guide groove 1411 may communicate partially with the rear-side third discharge port 1313*c*2 and partially with the front-side third discharge port 1313*c*1.

As described above, when the first guide groove 1411 of the first outflow guide portion 141 defining the inlet of the outflow passage 140 is located at a position ahead of the rear-side third discharge port 1313*c*2, which is the final discharge port, the outflow passage 140 serves as a kind of discharge port or bypass passage. That is, the refrigerant that has passed through the second discharge port 1313*b* may partially flow into the first outflow guide portion 141 constituting the inlet of the outflow passage 140. The refrigerant may also flow into the inner space 110*a* of the casing 110 through the second outflow guide portion 142 and the third outflow guide portion 143 that constitute the outflow passage 140.

As the outflow passage 140 serves as the third discharge port 1313*c*, the effective discharge area of the third discharge port 1313*c* may be enlarged, so that the refrigerant compressed in the compression chamber may be discharged more quickly. With this configuration, an amount of residual refrigerant that moves to the residual space without being discharged from a corresponding compression chamber may be reduced, thereby suppressing or preventing motor efficiency from being lowered due to over-compression in the compression space and wear and vibration noise due to chattering of the vane.

In addition, as the first guide groove 1411 is located ahead of the rear-side third discharge port 1313*c*2 and at the same position as or behind the front-side third discharge port 1313*c*1, refrigerant in a corresponding compression chamber may be prevented from being leaked without being sufficiently compressed.

Although not illustrated, when the rear-side third discharge port 1313*c*2 is located at the position, which is spaced 5°, namely, the minimum sealing distance a apart from the contact point p, the first guide groove 1411 may alternatively be located ahead of the front-side third discharge port 1313*c*2. In other words, the first guide groove 1411 may be located within a section from a position where it overlaps the rear-side third discharge port 1313*c*2 to a position ahead of the front-side third discharge port 1313*c*1. Even in these cases, the first guide groove 1411 may be formed to overlap the front-side third discharge port 1313*c*1 or/and the rear-side third discharge port 1313*c*2 by about 50% or more in the axial direction at a position at which it secures the minimum sealing distance. Also, in these cases, the operation effects are similar to those of the previous embodiment, and thus, repetitive description thereof has been omitted.

Hereinafter, of an outflow passage according to still another embodiment will be described. That is, in the previous embodiment, the inlet of the outflow passage is only one, but in some cases, the inlet of the outflow passage may be provided as a plurality.

Figure 11:
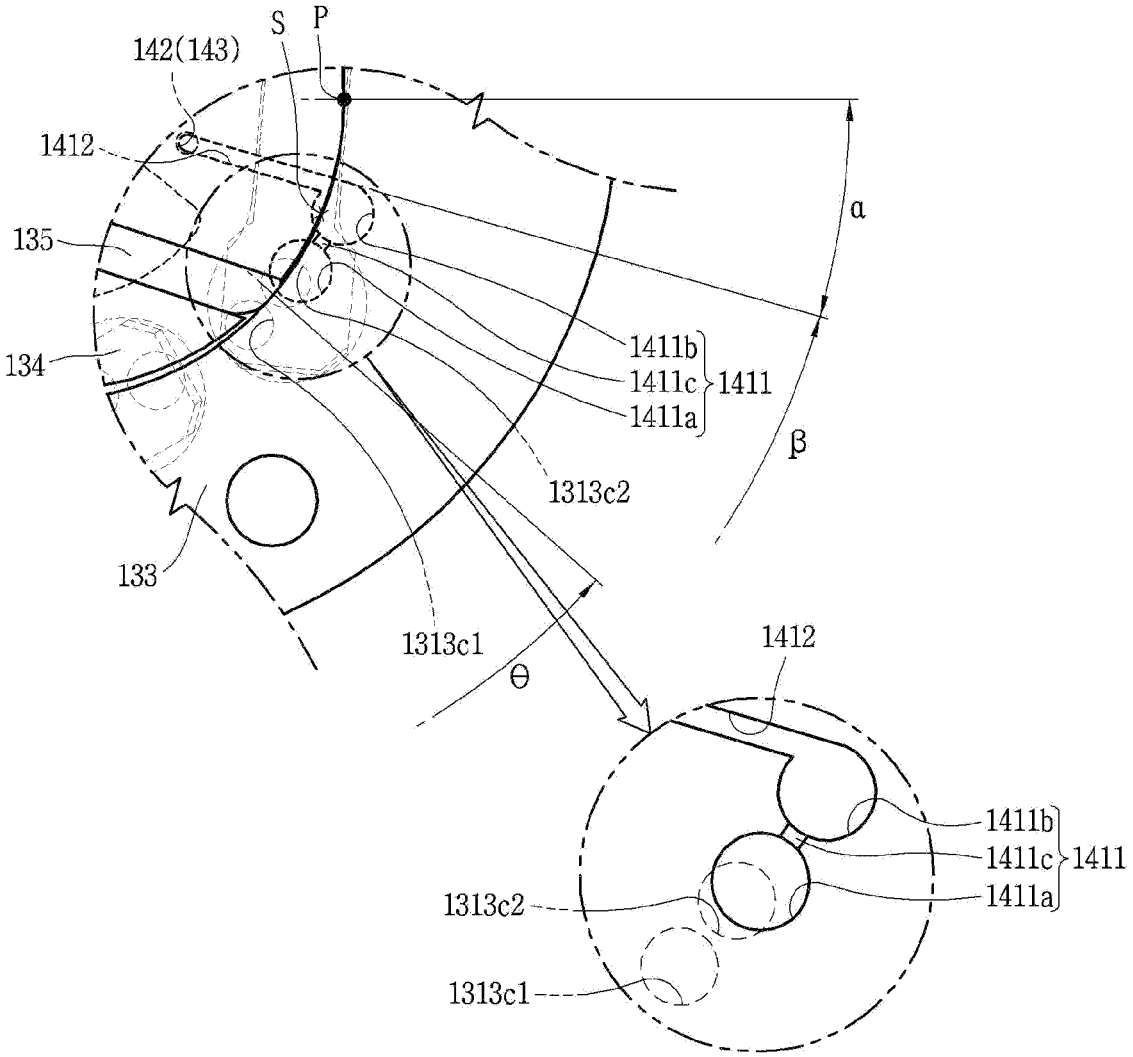
FIG. 11 is a planar view of an outflow passage according to still another embodiment.

FIG. 11 is a planar view of an outflow passage according to still another embodiment. Referring to FIG. 11, in this embodiment, the outflow passage 140 may include first outflow guide portion 141, second outflow guide portion 142, and third outflow guide portion 143. The basic configuration of the first outflow guide portion 141, the second outflow guide portion 142, and the third outflow guide portion 143 and the effects thereof are the same as those of the previous embodiment, so repetitive description thereof has been omitted.

However, the first outflow guide portion 141 according to this embodiment may include first guide groove 1411 and second guide groove 1412, but the first guide groove 1411 may be provided as a pair (i.e., 1411*a* and 1411*b*). In this case, the second guide groove 1412 may communicate with any one (for example, the rear-side first guide groove 1411*b*) of the two first guide grooves 1411*a* and 1411*b*, and the two second guide grooves 1411 may communicate with each other. For example, as illustrated in FIG. 11, the plurality of first guide grooves 1411*a* and 1411*b* may be spaced apart by a predetermined distance along the circumferential direction and may be connected to each other by an intermediate connection groove 1411*c*, or although not illustrated, may be formed to partially overlap each other in the circumferential direction.

In this case, the discharge passage arcuate angle β, as aforementioned, may be larger than or equal to the angle θ between the vanes, that is, the angle θ between the vanes may be 120° and the discharge passage arcuate angle β may be larger than or equal to approximately 120°. Accordingly, the discharge passage including the discharge port and the outflow passage 140 may extend to a circumferential range of a corresponding compression chamber or to outside of the circumferential range of the compression chamber, so as to minimize an amount of residual refrigerant in a corresponding compression chamber or the residual space S. In addition, as an arcuate length of the discharge passage is longer than or equal to an arcuate length of the compression chamber, a continuous discharge may be allowed, thereby reducing a pressure pulsation.

As described above, when the plurality of first guide grooves 1411*a* and 1411*b* is provided, a gap between the first sub back pressure pocket 1325*a* and the second sub back pressure pocket 1326*b* may be narrow. Accordingly, even when only one second guide groove 1412 is formed between the pockets, the plurality of first guide grooves 1411*a* and 1411*b* may be formed such that residual refrigerant or compressed refrigerant may flow more rapidly. This may suppress or prevent over-compression in the final compression chamber, thereby further enhancing motor efficiency.

Hereinafter, an outflow passage will be described according to still another embodiment. That is, the aforementioned outflow passage is formed with the same inner diameter, but in some cases, the outflow passage may have different inner diameters.

Figure 12:
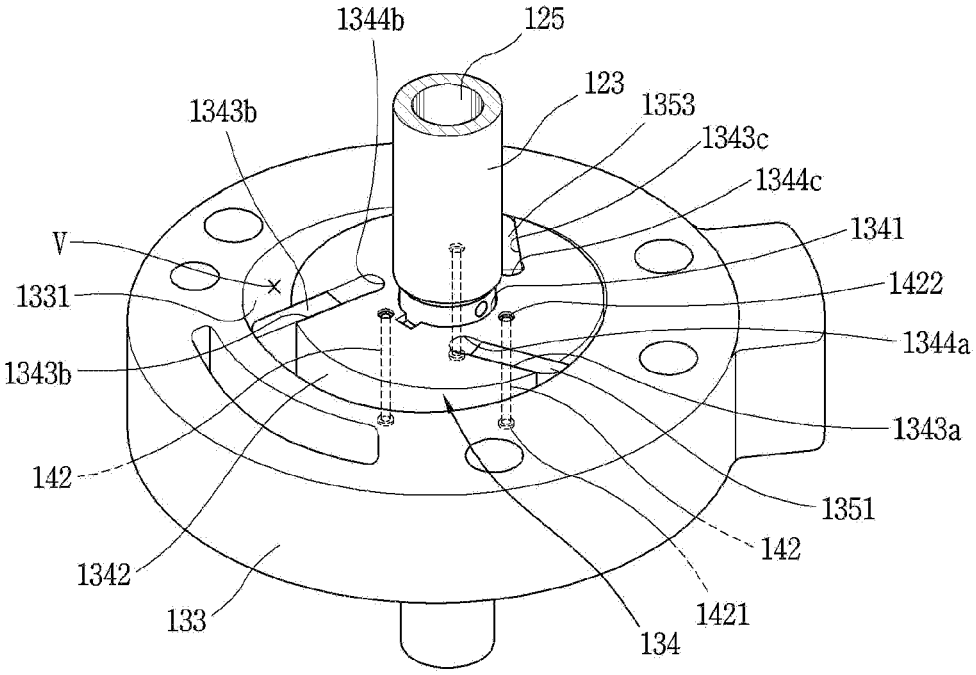
FIG. 12 is a perspective view of an outflow passage according to still another embodiment.
Figure 13:
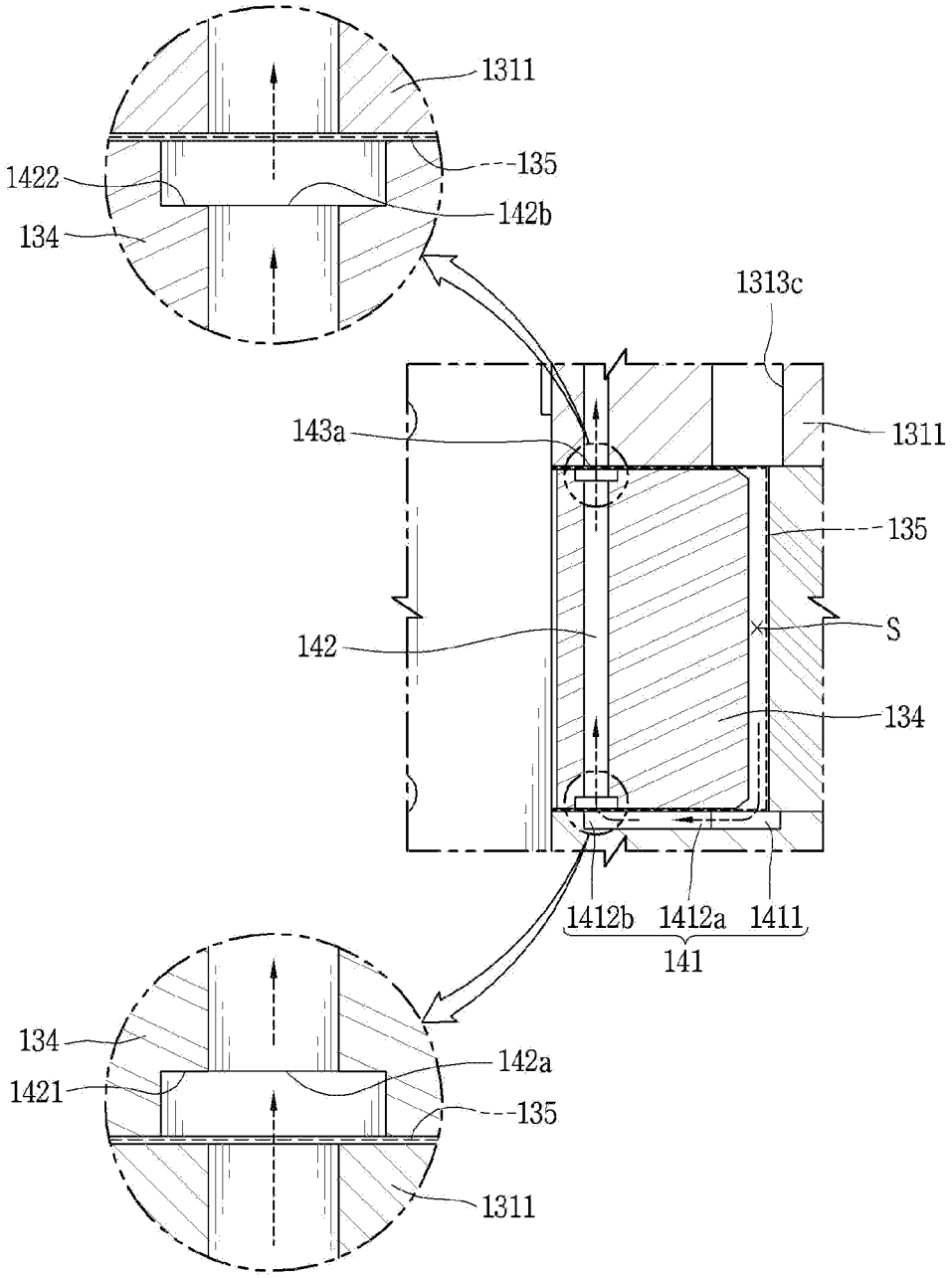
FIG. 13 is a cross-sectional view of the outflow passage of FIG. 12.

FIG. 12 is a perspective view of an outflow passage according to still another embodiment, and FIG. 13 is a cross-sectional view of FIG. 12. Referring to FIGS. 12 and 13, the outflow passage 140 according to this embodiment may include first outflow guide portion 141, second outflow guide portion 142, and third outflow guide portion 143. The basic configuration of the first outflow guide portion 141, the second outflow guide portion 142, and the third outflow guide portion 143 and the effects thereof are similar to those of the previous embodiments, so repetitive description thereof has been omitted.

However, an expansion groove 1421, 1422 having an expanded cross-sectional area may be formed at one end or each of both ends of the second outflow guide portion 142 according to this embodiment. For example, the expansion grooves 1421 and 1422 may be formed at both ends of the second outflow guide portion 142, respectively, and the respective expansion grooves 1421 and 1422 may be formed in the same shape or different shapes. Hereinafter, an example in which the expansion grooves 1421 and 1422 are formed in the same shape at both ends of the first outflow guide portion 142 will be mainly described.

For example, the inner diameter of the second outflow guide portion 142 may be the same as the width (or inner diameter) of the second guide groove 1412 of the first outflow guide portion 141, and each of the expansion grooves 1421 and 1422 may be formed to have an inner diameter which is greater than those of the first end 142*a* and the second end 142*b* of the second outflow guide portion 142. The expansion groove 1421 may be formed concentrically with the first end 142*a* of the second outflow guide portion 142, and in some cases, may be formed eccentrically with respect to the first end 142*a* of the second outflow guide portion 142.

When the expansion grooves 1421 and 1422 are formed at both ends of the second outflow guide portion 142 as described above, a communication period between the first outflow guide portion and the second outflow guide portion 142 and a communication period between the second outflow guide portion 142 and the third outflow guide portion 143 may be increased. Accordingly, residual refrigerant may flow out more quickly.

Although not illustrated, the expansion groove may be formed in the second guide groove 1412 of the first outflow guide portion 141 that the first end 142*a* of the second outflow guide portion 142 faces, and may alternatively be formed in the first end 143*a* of the third outflow guide portion 143 that the second end 142*b* of the second outflow guide portion 142 faces. Alternatively, the expansion groove may be formed in each of the first end 142*a* of the second outflow guide portion 142 and the second guide groove 1412 of the first outflow guide portion 141 facing the same, and may alternatively be formed in each of the second end 142*b* of the second outflow guide portion 142 and the first end 143*a* of the third outflow guide portion 143 facing the same. The operating effects for these embodiments may be similar to those of the previous embodiments, or the effect of exhausting residual refrigerant may be improved.

Hereinafter, of an outflow passage according to still another embodiment will be described. That is, the second outflow guide portion defining a part or portion of the aforementioned outflow passage is formed through the roller in the axial direction, but may alternatively be formed to be inclined with respect to the axial direction in some cases.

Figure 14:
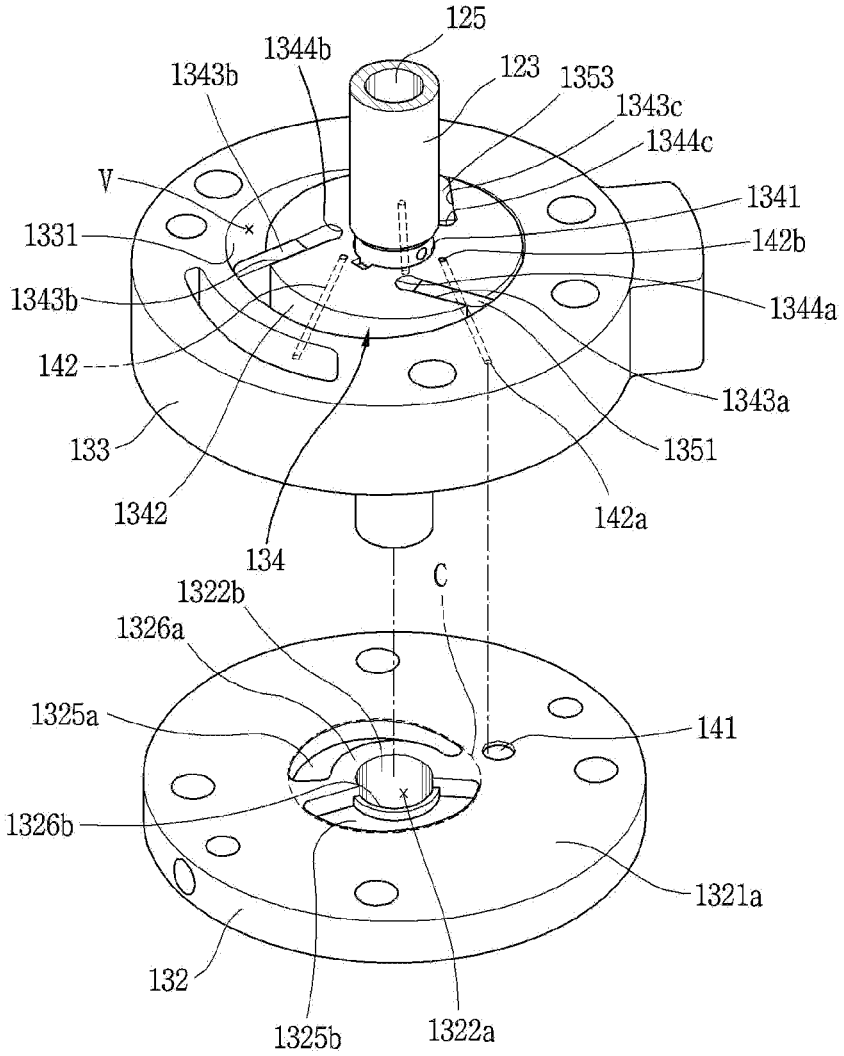
FIG. 14 is an exploded perspective view of an outflow passage according to yet another embodiment.
Figure 15:
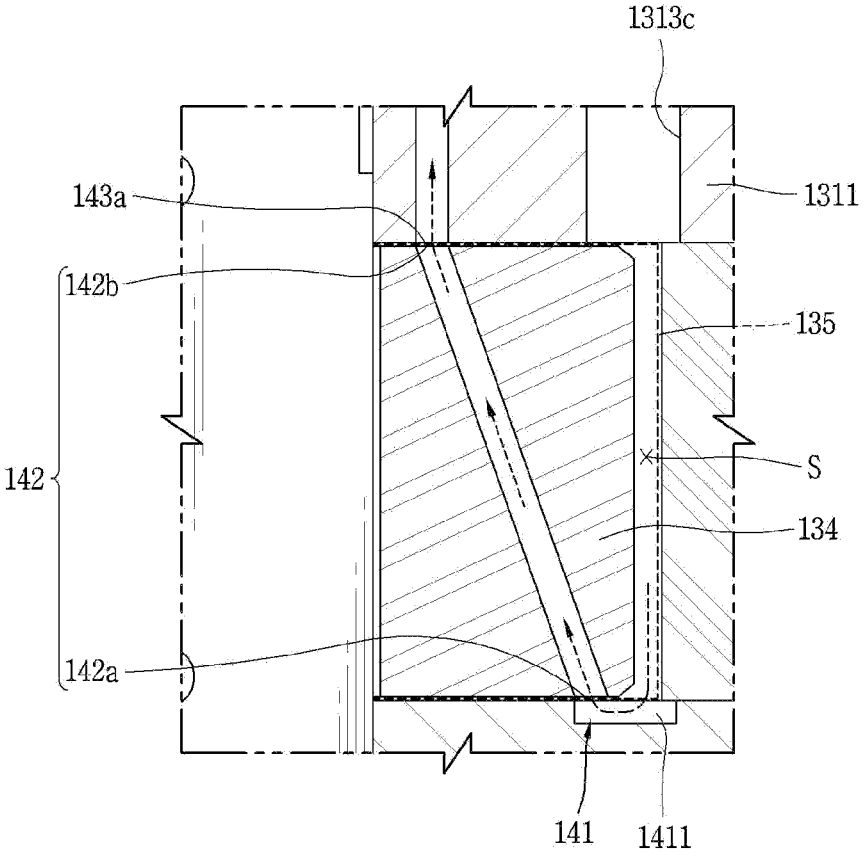
FIG. 15 is an assembled cross-sectional view of FIG. 14.

FIG. 14 is an exploded perspective view of an outflow passage according to still another embodiment. FIG. 15 is an assembled cross-sectional view of FIG. 14, and FIG. 16 is a schematic view illustrating an open state of the outflow passage of FIG. 14.

Figure 16:
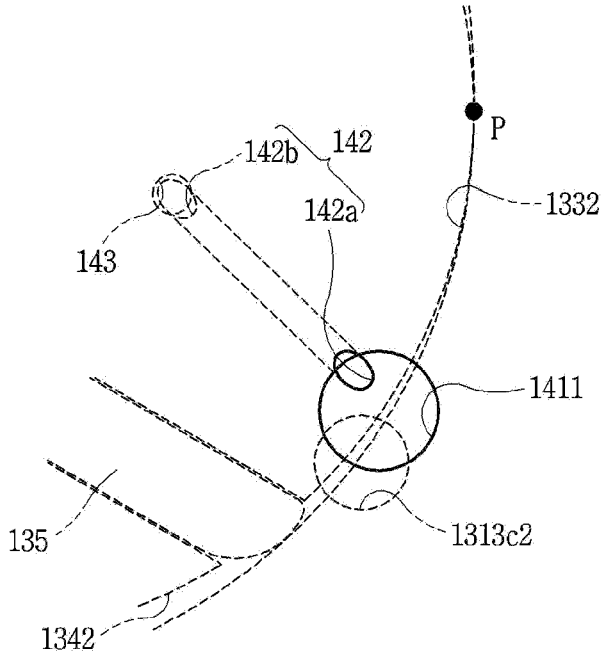
FIG. 16 is a schematic view illustrating an open state of the outflow passage of FIG. 14.

Referring to FIGS. 14 to 16, the outflow passage 140 according to this embodiment may include first outflow guide portion 141, second outflow guide portion 142, and third outflow guide portion 143. The basic configuration of the first outflow guide portion 141, the second outflow guide portion 142, and the third outflow guide portion 143 and the effects thereof are similar to those of the previous embodiments, so repetitive description thereof has been omitted.

However, the first outflow guide portion 141 and the first end 142*a* of the second outflow guide portion 142 according to this embodiment may be located outside of the first sub pocket 1325*a* and the second sub back pressure pocket 1325*b*, that is, located outside of a pocket virtual circle C, and the third outflow guide portion 143, as illustrated in the previous embodiments, may be located between the first main back pressure pocket 1315*a* and the second main back pressure pocket 1315*b*, that is, located inside of the pocket virtual circle C. Accordingly, the first outflow guide portion 141 may include a single guide groove differently from the previous embodiments.

For example, the first outflow guide portion 141 may include only the first guide groove 1411 without the second guide groove 1412 illustrated in the previous embodiment. In this case, the first guide groove 1411 may be formed to have a larger inner diameter than the third discharge port 1313 so that a part or portion thereof is located more inward than the outer circumferential surface 1342 of the roller 134 or may be formed in a radially long groove shape.

As described above, when the first outflow guide portion 141 has only one guide groove, that is, the single first guide groove 1411, the first outflow guide portion 141 may be easily processed. Also, as the first outflow guide portion 141 is located outside the first sub back pressure pocket 1325*a* and the second sub back pressure pocket 1325*b*, the degree of design freedom for the shape or location of the first outflow guide portion 141 may be increased.

Although not illustrated, when the first outflow guide portion 141 includes the first guide groove 1411 and the second guide groove 1412 as in the previous embodiment, a length of the second guide groove 1412 may be short. Even in this case, as the total length of the first outflow guide portion 141 is shortened, processing of the first outflow guide portion 141 may be facilitated. Also, as the first outflow guide portion 141 is located outside of the first sub back pressure pocket 1325*a* and the second sub back pressure pocket 1325*b*, the degree of design freedom for the shape or location of the first outflow guide portion 141 may be increased.

Also, as the first outflow guide portion 141 and the third outflow guide portion 143 are located on different axes, the second outflow guide portion 142 may be inclined. For example, the first end 142*a* of the second outflow guide portion 142 may be located outside of the pocket virtual circle C so as to be located on the same axis as the first outflow guide portion 141, and the second end 142*b* of the second outflow guide portion 142 may be located inside of the pocket virtual circle C to be located on the same axis as the third outflow guide portion 143.

As the second outflow guide portion 142 is inclined as described above, refrigerant passing through the second outflow guide portion 142 may receive centrifugal force, and refrigerant of the residual space S or the compression space V in the course of the discharge stroke may more quickly flow out to the third outflow guide portion 143 through the second outflow guide portion 142.

Hereinafter, an outflow passage according to still another embodiment will be described. That is, in the previous embodiments, the outlet of the outflow passage is formed through the main bush portion of the main bearing, but in some cases, the inlet of the outflow passage may be formed almost on the same axis as the discharge port.

Figure 17:
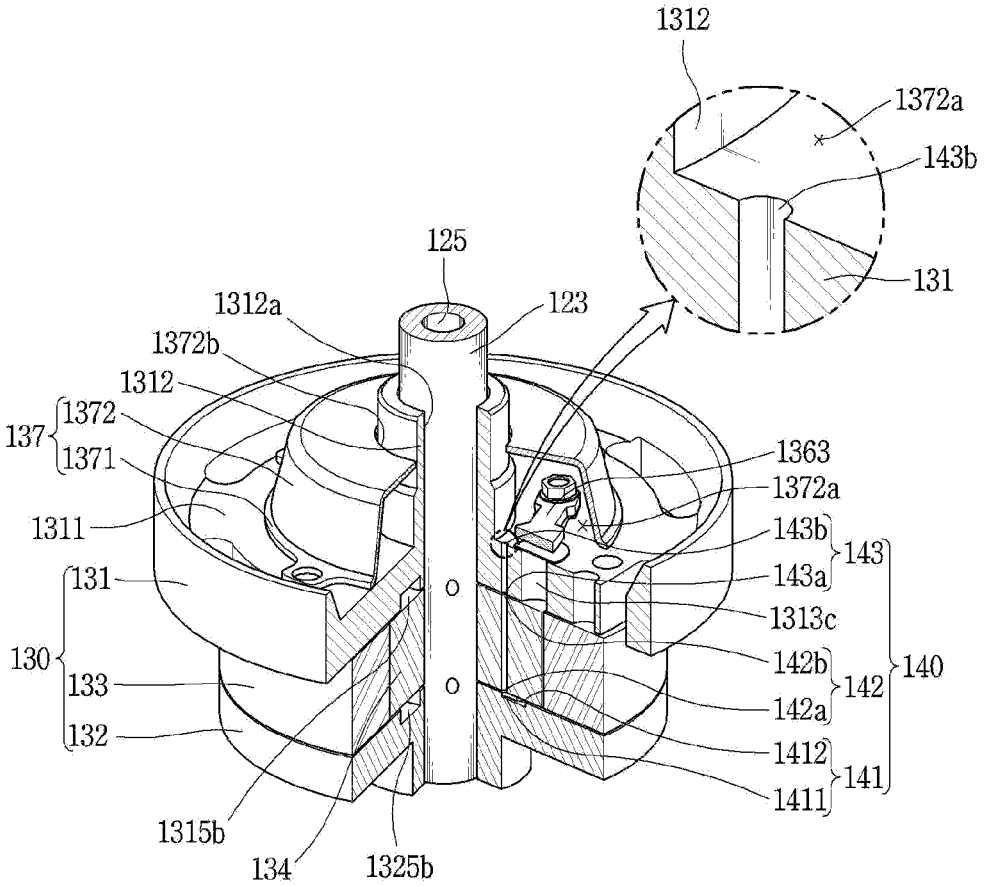
FIGS. 17 and 18 are a perspective view and a cross-sectional view of an outflow passage according to yet another embodiment.
Figure 18:
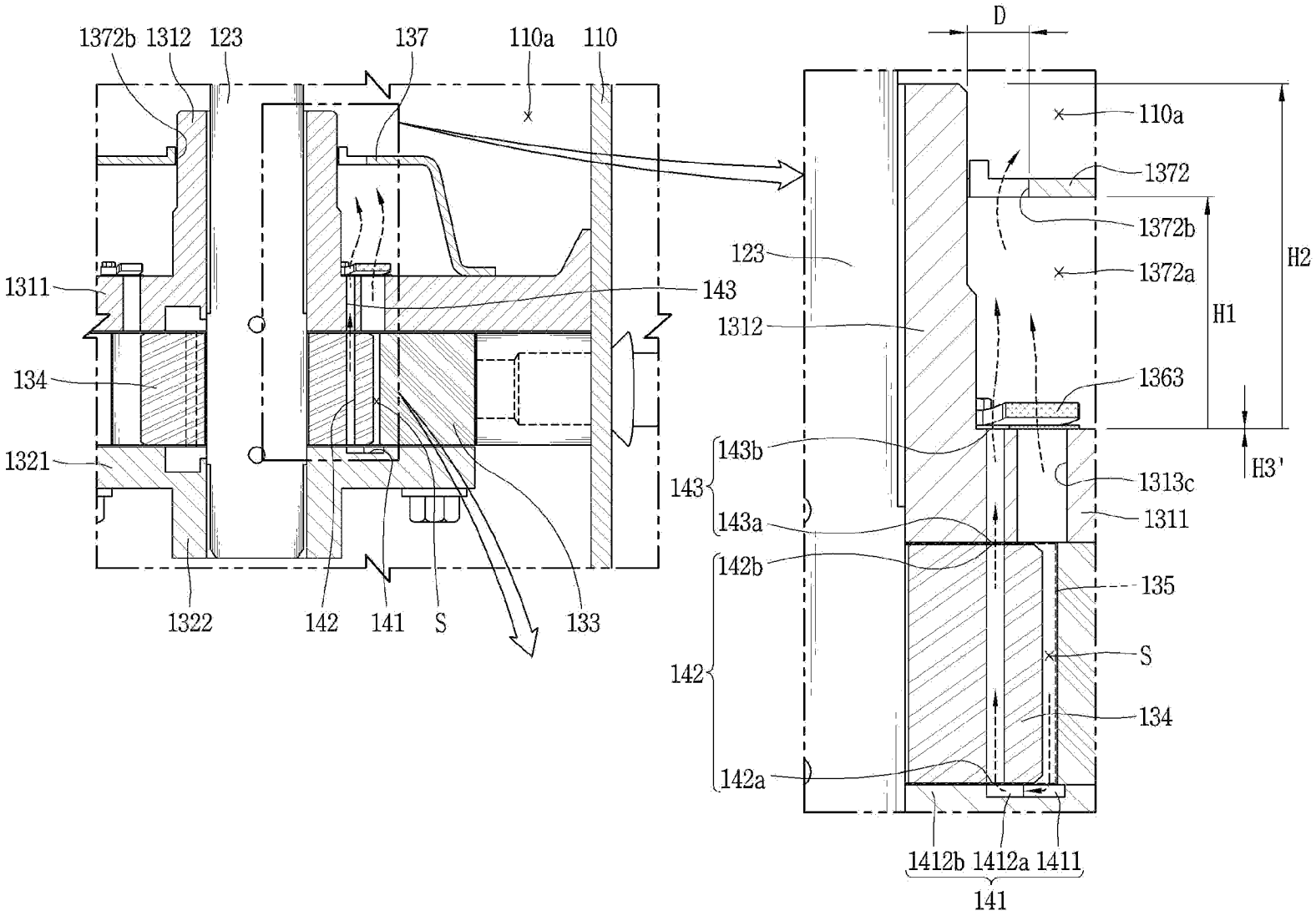

FIGS. 17 and 18 are a perspective view and a cross-sectional view of an outflow passage according to still another embodiment. Referring to FIGS. 17 and 18, the outflow passage 140 according to this embodiment may include first outflow guide portion 141, second outflow guide portion 142, and third outflow guide portion 143. The basic configuration of the first outflow guide portion 141, the second outflow guide portion 142, and the third outflow guide portion 143 and the effects thereof are the same as those of the previous embodiment, so repetitive description has been omitted.

However, the first end 143*a* of the third outflow guide portion 143 according to this embodiment may be open toward the lower surface of the main plate portion 1311 defining the main sliding surface 1311*a* facing the roller 134 in the axial direction, and the second end 143*b* of the third outflow guide portion 143 may be open toward the discharge space portion 1372 of the discharge muffler 137 from the upper surface of the main plate portion 1311. In other words, as the second end 143*b* of the third outflow guide portion 143 is formed on the main plate portion 1311, a height H3' of the second end 143*b* of the third outflow guide portion 143 may be lower than a height H1 of the discharge space portion 1372.

In this case, the second end 143*b* of the third outflow guide portion 143 may be located between the first main back pressure pocket 1315*a* and the second main back pressure pocket 1315*b*, but may be spaced apart from each of the discharge valves 1361, 1362, and 1363. Accordingly, the third discharge guide portion 143 may always be open without being closed by each of the discharge valves 1361, 1362, and 1363, so as to guide the refrigerant to flow into the discharge space portion 1372*a* of the discharge muffler 137 through the third outflow guide portion 143.

As described above, when the third outflow guide portion 143 is formed through the main plate portion 1311, a length of the third outflow guide portion 143 may be shortened, which may facilitate processing of the third outflow guide portion 143. In particular, even when the third outflow guide portion 143 has a small inner diameter, its processing may be facilitated and a manufacturing cost may be reduced.

In addition, as the third outflow guide portion 143 is formed in the main plate portion 1311, a length of the first outflow guide portion 141, that is, a length of the second guide groove 1412 may be shortened, which may facilitate processing of the first outflow guide portion 141. In addition, in some cases, the second guide groove 1412 may be formed outside of the first main back pressure pocket and the second main back pressure pocket, that is, outside of the pocket virtual circle C connecting the outer circumferential surface of the first main back pressure pocket 1315*a* and the outer circumferential surface of the second main back pressure pocket 1315*b*. In this case, a width of the second guide groove 1412 may be widened or the second guide grooves 1412 may be provided as a plurality, so that refrigerant may flow out more quickly.

Although not illustrated, the discharge ports 1313*a*, 1313*b*, and 1313*c* may alternatively be formed in the sub bearing 132. In this case, the first outflow guide portion 141 defining the outflow passage 140 may be formed in the main bearing 131, the second outflow guide portion 142 may be formed in the roller 134, and the third outflow guide portion 143 may be formed in the sub bearing 132, respectively. Even in this case, the configuration of the first outflow guide portion 141, the second outflow guide portion 142, and the third outflow guide portion 143 and the effects thereof may be the same as those in the foregoing embodiments, and repetitive description has been omitted.

In addition, in the previous embodiments described above, the discharge grooves 1314 may extend from some discharge ports. For example, the discharge grooves 1314 may extend from the first discharge port 1313*a* and the second discharge port 1313*b*, respectively, to each have an arcuate shape along a direction in which compression is in progress (i.e., the rotational direction of the roller). Accordingly, refrigerant, which has not flowed out of a preceding compression chamber, may be guided to the discharge port 1313*a*, 1313*b* communicating with a succeeding compression chamber through the discharge groove 1314, so as to be discharged together with refrigerant compressed in the succeeding compression chamber. As a result, residual refrigerant in the compression space V may be minimized to thereby suppress or prevent over-compression. Thus, efficiency of the compressor may be enhanced.

Embodiments disclosed herein provide a rotary compressor capable of reducing an amount of residual refrigerant remaining in a compression space without being discharged. Embodiments disclosed herein also provide a rotary compressor capable of preventing refrigerant from leaking out in a compression stroke while reducing an amount of residual refrigerant in a compression space.

Embodiments disclosed herein further provide a rotary compressor in which a residual space may periodically communicate with an inner space of a casing. Embodiments disclosed herein furthermore provide a rotary compressor capable of quickly discharging refrigerant in a discharge stroke.

Embodiments disclosed herein provide a rotary compressor capable of increasing an amount of discharge refrigerant by widening an effective discharge area of refrigerant. Embodiments disclosed herein also provide a rotary compressor capable of extending a substantial discharge stroke.

Embodiments disclosed herein provide a rotary compressor capable of reducing vibration noise of the compressor while suppressing or preventing wear of a vane or a cylinder. Embodiments disclosed herein further provide a rotary compressor capable of resolving a difference between pressure acting on a front surface of a vane and back pressure acting on a rear surface of the vane.

Embodiments disclosed herein provide a rotary compressor capable of adjusting pressure acting on a front surface of a vane to be uniform.

Embodiments disclosed herein further provide a rotary compressor capable of suppressing or preventing chattering of vanes even when a high-pressure refrigerant, such as R32, R410a, or $CO_2$, is used.

A rotary compressor according to embodiments disclosed herein may include a casing, a cylinder, a roller, a vane, a main bearing, a sub bearing, and an outflow passage. The casing may have a hermetic inner space. The cylinder may be disposed in the inner space of the casing to define a compression space. The roller may be disposed on a rotational shaft so as to be rotatable in the inner space of the cylinder and eccentrically located with respect to a center of the compression space to have a contact point close to an inner circumferential surface of the cylinder. The vane may be slidably inserted into a vane slot provided in the roller to rotate together with the roller. The main bearing and the sub bearing may be disposed on both sides of the cylinder in the axial direction to form the compression space together with the cylinder. A portion of the outflow passage may be formed through the roller. Accordingly, a residual space after a discharge stroke or a compression space in the course of a discharge stroke may periodically communicate with the inner space of the casing according to a rotational angle of the roller. This may simplify structure of the cylinder to allow for easy processing of the cylinder, and lower surface pressure between the vane and the cylinder around a discharge hole to reduce chattering of the vane, thereby suppressing or preventing wear and vibration noise between the vane and the cylinder. In addition, refrigerant remaining in the residual space may flow out or refrigerant in the course of a discharge stroke may be quickly discharged, thereby reducing an amount of refrigerant remaining in the compression space. A pressure difference between front and rear sides of the vane may also be reduced, thereby reducing wear and vibration noise due to chattering of the vane.

For example, the outflow passage may be periodically open according to the rotation of the roller. With this configuration, refrigerant after a discharge stroke or in the course of the discharge stroke may flow out periodically while refrigerant before the discharge stroke may be prevented from being discharged in advance, thereby preventing under-compression.

The outflow passage may be provided as a plurality at equal intervals along a circumferential direction of the roller. The outflow passages may be open with the same rotational angle, so that refrigerant after a discharge stroke or in the course of the discharge stroke may periodically flow out at equal intervals.

A plurality of vane slots may be formed in the roller along a circumferential direction. Portions of the outflow passage may be formed between adjacent vane slots of the plurality of vane slots, respectively. With this configuration, refrigerant compressed in each compression chamber may periodically flow out through each outflow passage according to the rotational angle of the roller.

A rotary compressor according to embodiments disclosed herein may include a casing, a cylinder, a roller, a vane, a main bearing, a sub bearing, and an outflow passage. The casing may have a hermetic inner space. The cylinder may be disposed in an inner space of the casing to define a compression space. The roller may be disposed on a rotational shaft so as to be rotatable in the cylinder and eccentrically located with respect to a center of the compression space to have a contact point close to an inner circumferential surface of the cylinder. The vane may be slidably inserted into a vane slot provided in the roller to rotate together with the roller. The main bearing and the sub bearing may be disposed on both sides of the cylinder in the axial direction to form the compression space together with the cylinder. The outflow passage may include a first outflow guide portion, a second outflow guide portion, and a third outflow guide portion through which refrigerant may flow from the compression space to the inner space of the casing. The first outflow guide portion may be disposed in the main bearing or the sub bearing. The second outflow guide portion may be formed through between both axial ends of the roller and communicate with the first outflow guide portion. The third outflow guide portion may be disposed in a bearing opposite to the bearing provided with the first outflow guide portion based on the roller, and communicate with the first outflow guide portion through the second outflow guide portion. With this configuration, refrigerant remaining in a residual space may flow out so as to decrease an amount refrigerant remaining in the compression space, and an effective discharge area may substantially increase such that compressed refrigerant may flow out quickly, thereby reducing an amount of residual refrigerant and improving compression efficiency. In addition, a pressure difference on a front surface of a vane may be eliminated, which may result in suppressing or preventing vane jumping, thereby reducing wear of the vane or the cylinder. As the outflow passage is periodically open, leakage of refrigerant may be suppressed or prevented during a compression stroke, resulting in preventing an occurrence of under-compression.

For example, the second outflow guide portion may periodically communicate with the first outflow guide portion. This may reduce an amount of residual refrigerant and suppress or prevent leakage of compressed refrigerant.

As another example, the second outflow guide portion may periodically communicate with the third outflow guide portion. This may reduce an amount of residual refrigerant and suppress or prevent leakage of compressed refrigerant.

As another example, the first outflow guide portion may periodically communicate with the third outflow guide portion by the second outflow guide portion when the roller rotates. This may reduce an amount of residual refrigerant and suppress or prevent leakage of compressed refrigerant.

As another example, the number of second outflow guide portions may be greater than the number of first outflow guide portions or the number of third outflow guide portions. This may allow refrigerant in the residual space to flow out smoothly while leakage of refrigerant being compressed may be suppressed or prevented.

More specifically, each of the first outflow guide portion and the third outflow guide portion may be provided as one in number. The second outflow guide portion may be provided as a plurality disposed at preset or predetermined intervals along a circumferential direction. Accordingly, the outflow passage through which residual refrigerant flows out may be open once per rotation of the roller, and may be periodically open in a residual space communicating with a final compression chamber.

In addition, the first outflow guide portion and the third outflow guide portion facing the second outflow guide portion may be formed on a same axis. The second outflow guide portion may be formed in a penetrating manner in the axial direction. This may minimize a length of the second outflow guide portion, such that the second outflow guide portion may be easily processed and simultaneously residual refrigerant may quickly flow out.

In addition, the first outflow guide portion and the third outflow guide portion facing the second outflow guide portion may be formed on different axes. The second outflow guide portion may be formed in a penetrating manner to be inclined with respect to the axial direction. This may facilitate processing of the first outflow guide portion and increase the degree of freedom for designing the first outflow guide portion. In addition, as the second outflow guide portion is formed to be inclined, centrifugal force with respect to refrigerant passing through the second outflow guide portion may increase, so that refrigerant of the residual space or a compression space in the course of a discharge stroke may flow out more quickly.

As another example, the first outflow guide portion may include a first guide groove that communicates with the compression space, and a second guide groove having one (first) end that communicates with the first guide groove and another (second) end that communicates with the second outflow guide portion. The second guide groove may extend closer to a center of rotation of the roller than the first guide groove. This may allow refrigerant in the residual space to periodically pass through the roller so as to flow into the inner space of the casing.

More specifically, at least one discharge port may be formed in the main bearing or the sub bearing. The first guide groove may at least partially overlap the discharge port in the axial direction. This may expand an effective discharge area of refrigerant, such that refrigerant may be quickly discharged from the compression space or residual refrigerant may smoothly flow out.

More specifically, the first guide groove may overlap the discharge port in the axial direction by at least 50% or more. This may further expand an effective discharge area of refrigerant, such that refrigerant may be more quickly discharged from the compression space or residual refrigerant may more smoothly flow out.

Also, at least one discharge port may be formed in the main bearing or the sub bearing. The first guide groove may have a cross-sectional area that is greater than or equal to that of the discharge port which the first guide groove overlaps in the axial direction. With this configuration, refrigerant may be more quickly discharged from the compression space or residual refrigerant may more smoothly flow out.

Also, at least one discharge port may be formed in the main bearing or the sub bearing. The first guide groove may be located at a position behind the discharge port, which the first guide groove overlaps in the axial direction, based on a rotational direction of the roller. This may allow residual refrigerant remaining in the residual space after the discharge stroke to effectively flow out so as to increase compression efficiency and suppress or prevent vane jumping, thereby suppressing or preventing wear of the vane or cylinder.

For example, the first guide groove may be provided as a plurality in a circumferential direction, and an intermediate connection groove may be disposed between the plurality of first guide grooves such that the plurality of first guide grooves communicate with each other. With this configuration, the discharge passage may extend to a circumferential range of a corresponding compression chamber or to outside of the circumferential range of the compression chamber, thereby minimizing an amount of residual refrigerant. In addition, as an arcuate length of the discharge passage is longer than or equal to an arcuate length of the compression chamber, a continuous discharge may be allowed, thereby reducing a pressure pulsation.

Also, at least one discharge port may be formed in the main bearing or the sub bearing. The first guide groove may be located at a position ahead of the discharge port, which the first guide groove overlaps in the axial direction, based on a rotational direction of the roller. This may expand an effective discharge area of refrigerant such that refrigerant of a compression chamber may be more quickly discharged, and may reduce an amount of refrigerant moving to the residual space to reduce an amount of residual refrigerant.

For example, a plurality of discharge ports may be formed in the main bearing or the sub bearing. The first guide groove may be located between the plurality of discharge ports so as to communicate with the plurality of discharge ports, respectively. This may increase an effective discharge area of the discharge port, so that refrigerant in a compression chamber may be rapidly discharged.

In addition, a plurality of back pressure pockets each having different pressure may be spaced apart from each other in a circumferential direction on one side surface of the main bearing and one side surface of the sub bearing that face the roller in the axial direction. The second guide groove may be formed thinner and longer than the first guide groove, and disposed between the plurality of back pressure pockets in the circumferential direction. With this configuration, the outflow passage may be formed through the roller to be periodically open.

As another example, the vane slot may be provided as a plurality disposed along a circumferential direction. The second outflow guide portions may be disposed between the vane slots adjacent to each other in the circumferential direction. Accordingly, as the outflow passage is open periodically, an amount of residual refrigerant may be reduced and leakage of compressed refrigerant may be suppressed. or prevented Expansion grooves each having an expanded cross-sectional area may be formed in both ends of the second outflow guide portion and at least one of an end portion of the first outflow guide portion and an end portion of the third outflow guide portion. With this configuration, a period in which the outflow passages are open by communicating with each other may be increased, such that a residual refrigerant may flow out more quickly.

As another example, a plurality of back pressure pockets each having different pressure may be spaced apart from each other in a circumferential direction on one side surface of the main bearing and one side surface of the sub bearing that face the roller in the axial direction. The third outflow guide portion may be disposed between the plurality of back pressure pockets in the circumferential direction. Accordingly, as the outflow passage is open periodically, an amount of residual refrigerant may be reduced and leakage of compressed refrigerant may be suppressed or prevented.

As another example, the main bearing or the sub bearing may include a discharge muffler that accommodates the discharge port. The third discharge guide portion may be open toward the inner space of the casing at outside of the discharge muffler. With this configuration, refrigerant may be discharged at the outside of the discharge muffler, and accordingly, an increase in internal pressure of the discharge muffler may be prevented, such that a discharge valve may be quickly open, and simultaneously a vortex phenomenon in a discharge space may be suppressed or prevented such that refrigerant may be discharged more quickly through each discharge port.

More specifically, the main bearing or the sub bearing may include a plate portion coupled to an axial side surface of the cylinder, and a boss portion extending from the plate portion in the axial direction, such that the rotational shaft is inserted therethrough. The third outflow guide portion may be open toward the inside of the casing at the boss portion.

As another example, the main bearing or the sub bearing may include a discharge muffler that accommodates the discharge port. The third outflow guide portion may be open toward an inner surface of the discharge muffler. This may reduce a length of the outflow passage disposed in the bearing, thereby facilitating processing of the outflow passage.

More specifically, the main bearing or the sub bearing may include a plate portion coupled to an axial side surface of the cylinder, and a boss portion extending from the plate portion in the axial direction, such that the rotational shaft is inserted therethrough. The third outflow guide portion may be formed through the plate portion.

As another example, a discharge port that is open and closed by a discharge valve may be disposed in any one of the main bearing and the sub bearing. The first outflow guide portion may be formed in a bearing without the discharge port. Through this, refrigerant remaining in the compression space may periodically flow out, which may result in reducing an amount of residual refrigerant and preventing under-compression in advance.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present.

As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A rotary compressor, comprising:

a casing;

a cylinder disposed in an inner space of the casing to define a compression space;

a roller disposed on a rotational shaft so as to be rotatable in an inner space of the cylinder and eccentrically located with respect to a center of the compression space to have a contact point close to an inner circumferential surface of the cylinder;

at least one vane slidably inserted into at least one vane slot provided in the roller to rotate together with the roller;

a main bearing and a sub bearing, respectively, disposed on both sides of the cylinder in an axial direction to define the compression space together with the cylinder; and at least one outflow passage through which refrigerant flows from the compression space to the inner space of the casing, wherein the at least one outflow passage comprises:

at least one first outflow guide portion disposed in the main bearing or the sub bearing;

at least one second outflow guide portion formed through both ends of the roller in the axial direction and communicating with the at least one first outflow guide portion; and at least one third outflow guide portion disposed in a bearing of the main bearing and the sub bearing opposite to the bearing of the main bearing and the sub bearing provided with the at least one first outflow guide portion based on the roller, and communicating with the at least one first outflow guide portion through the at least one second outflow guide portion which is disposed from the one end to the other end of the roller in the axial direction.

2. The rotary compressor of claim 1, wherein the at least one second outflow guide portion periodically communicates with at least one of the at least one first outflow guide portion or the at least one third outflow guide portion, in response to rotation of the roller.

3. The rotary compressor of claim 1, wherein the at least one first outflow guide portion and the at least one third outflow guide portion communicate with each other through the at least one second outflow guide portion according to a rotational angle of the roller.

4. The rotary compressor of claim 1, wherein a number of the at least one second outflow guide portion is greater than a number of the at least one first outflow guide portion or a number of the at least one third outflow guide portion.

5. The rotary compressor of claim 1, wherein each of the at least one first outflow guide portion and the at least one third outflow guide portion is provided as one in number, and wherein the at least one second outflow guide portion comprises a plurality of second outflow guide portions disposed at predetermined intervals along a circumferential direction.

6. The rotary compressor of claim 5, wherein the first outflow guide portion and the third outflow guide portion facing the second outflow guide portion are formed on a same axis, and wherein the second outflow guide portion is formed in a penetrating manner in the axial direction.

7. The rotary compressor of claim 5, wherein the first outflow guide portion and the third outflow guide portion facing the second outflow guide portion are formed on different axes, and wherein the second outflow guide portion is formed in a penetrating manner to be inclined with respect to the axial direction.

8. The rotary compressor of claim 1, wherein the at least one first outflow guide portion comprises:

at least one first guide groove that communicates with the compression space; and a second guide groove having a first end that communicates with the at least one first guide groove and a second end that communicates with the second outflow guide portion, and wherein the second guide groove extends closer to a center of rotation of the roller than the at least one first guide groove.

9. The rotary compressor of claim 8, wherein at least one discharge port is formed in the main bearing or the sub bearing, and wherein the at least one first guide groove at least partially overlaps the at least one discharge port in the axial direction.

10. The rotary compressor of claim 8, wherein at least one discharge port is formed in the main bearing or the sub bearing, and wherein the at least one first guide groove has a cross-sectional area that is greater than or equal to a cross-sectional area of the at least one discharge port which the at least one first guide groove overlaps in the axial direction.

11. The rotary compressor of claim 8, wherein at least one discharge port is formed in the main bearing or the sub bearing, and wherein the at least one first guide groove is located at a position behind the at least one discharge port, which the at least one first guide groove overlaps in the axial direction, based on a rotational direction of the roller.

12. The rotary compressor of claim 11, wherein the at least one first guide groove comprises a plurality of first guide grooves disposed in a circumferential direction, and an intermediate connection groove is disposed between the plurality of first guide grooves such that the plurality of first guide grooves communicates with each other.

13. The rotary compressor of claim 8, wherein at least one discharge port is formed in the main bearing or the sub bearing, and wherein the at least one first guide groove is located at a position ahead of the at least one discharge port, which the at least one first guide groove overlaps in the axial direction, based on a rotational direction of the roller.

14. The rotary compressor of claim 13, wherein a plurality of discharge ports is formed in the main bearing or the sub bearing, and wherein the at least one first guide groove is located between the plurality of discharge ports so as to communicate with the plurality of discharge ports, respectively.

15. The rotary compressor of claim 8, wherein a plurality of back pressure pockets, each having a different pressure, is spaced apart from each other in a circumferential direction in one side surface of the main bearing and one side surface of the sub bearing that face the roller in the axial direction, and wherein the second guide groove is thinner and longer than the at least one first guide groove, and disposed between the plurality of back pressure pockets in the circumferential direction.

16. The rotary compressor of claim 1, wherein the at least one vane slot comprises a plurality of vane slots along a circumferential direction, wherein the at least one second outflow guide portions comprises a plurality of second outflow guide portions disposed between the plurality of vane slots adjacent to each other in the circumferential direction, and wherein expansion grooves each having an expanded cross-sectional area are formed in both ends of each second outflow guide portion and at least one of an end portion of the at least one first outflow guide portion and an end portion of the at least one third outflow guide portion.

17. The rotary compressor of claim 1, wherein a plurality of back pressure pockets, each having a different pressure, is spaced apart from each other in a circumferential direction in one side surface of the main bearing and one side surface of the sub bearing that face the roller in the axial direction, and wherein the at least one third outflow guide portion is disposed between the plurality of back pressure pockets in the circumferential direction.

18. The rotary compressor of claim 1, wherein the main bearing or the sub bearing comprises:

a plate portion coupled to an axial side surface of the cylinder; and a bush portion that extends in one axial side surface of the plate portion in the axial direction, such that the rotational shaft is inserted therethrough, wherein a discharge muffler that accommodates a discharge port is disposed in the main bearing or the sub bearing, wherein the at least one third outflow guide portion is open toward the inner space of the casing at an outside of the discharge muffler, and wherein the at least one third outflow guide portion is open toward an inside of the casing at the bush portion.

19. The rotary compressor of claim 1, wherein the main bearing or the sub bearing comprises:

a plate portion coupled to an axial side surface of the cylinder; and a bush portion that extends in one axial side surface of the plate portion in the axial direction, such that the rotational shaft is inserted therethrough, wherein a discharge muffler that accommodates the discharge port is disposed in the main bearing or the sub bearing, wherein the at least one third outflow guide portion is open toward an inner surface of the discharge muffler, and wherein the at least one third outflow guide portion is formed through the plate portion.

20. The rotary compressor of claim 1, wherein at least one discharge port opened and closed by a discharge valve is disposed in any one of the main bearing or the sub bearing, and wherein the at least one first outflow guide portion is formed in a bearing of the main bearing or the sub bearing without the comprises discharge port.

* * * * *